US007497778B2

(12) United States Patent
Bozeman

(10) Patent No.: US 7,497,778 B2
(45) **Date of Patent: *Mar. 3, 2009**

(54) LOTTERY GAME BASED ON WORDS OR PHRASES

(75) Inventor: Alan Kyle Bozeman, Alpharetta, GA (US)

(73) Assignee: Scientific Games International, Inc., Newark, DE (US)

( * ) Notice: Subject to any disclaimer, the term of this patent is extended or adjusted under 35 U.S.C. 154(b) by 853 days.

This patent is subject to a terminal disclaimer.

(21) Appl. No.: 11/007,535

(22) Filed: Dec. 8, 2004

(65) Prior Publication Data

US 2005/0085289 A1 Apr. 21, 2005

Related U.S. Application Data

(63) Continuation-in-part of application No. 10/681,447, filed on Oct. 8, 2003, now Pat. No. 7,404,764, which is a continuation of application No. 10/662,736, filed on Sep. 15, 2003, now Pat. No. 7,407,437.

(60) Provisional application No. 60/604,444, filed on Aug. 25, 2004.

(51) Int. Cl.
*A63F 9/24* (2006.01)

(52) U.S. Cl. ..... 463/17; 463/9; 463/25; 463/40; 273/269; 283/49; 283/903; 379/93.13

(58) Field of Classification Search ..... None
See application file for complete search history.

(56) References Cited

U.S. PATENT DOCUMENTS

| | | | | |
|---|---|---|---|---|
| 4,157,829 | A * | 6/1979 | Goldman et al. | 463/17 |
| 4,494,197 | A * | 1/1985 | Troy et al. | 463/18 |
| 5,112,050 | A * | 5/1992 | Koza et al. | 463/17 |
| 5,207,435 | A * | 5/1993 | Tanner | 273/429 |
| 5,613,679 | A * | 3/1997 | Casa et al. | 273/138.1 |
| 5,772,510 | A * | 6/1998 | Roberts | 463/17 |
| 5,788,573 | A * | 8/1998 | Baerlocher et al. | 463/16 |
| 5,921,864 | A * | 7/1999 | Walker et al. | 463/9 |
| 6,017,032 | A | 1/2000 | Grippo et al. | |
| 6,024,641 | A * | 2/2000 | Sarno | 463/17 |

(Continued)

OTHER PUBLICATIONS

The official rules of Scrabble as retrieved from website (www.thepixiepit.co.uk/scrabble/rules.html), copyright 1999, 6 pages.*

(Continued)

*Primary Examiner*—M. Sager
(74) *Attorney, Agent, or Firm*—Dority & Manning, P.A.

(57) ABSTRACT

A word-based lottery game wherein a player buys a ticket with a word or set of words and may win a prize if the outcome of a draw confers a win status to one or more words in the ticket. The draw is a random process for which an outcome is a concatenation of characters and may confer word a winner based upon a rule such as being able to compose the word with the drawn characters.

29 Claims, 41 Drawing Sheets

| | | | |
|---|---|---|---|
| A:7.7% | B:1.7% | C:2.6% | D:4.3% |
| E:12.4% | F:2.4% | G:2.1% | H:5.7% |
| I:7.3% | J:0.1% | K:0.6% | L:3.4% |
| M:2.9% | N:7.4% | O:7.8% | P:2.1% |
| Q:0.1% | R:6.0% | S:6.0% | T:9.2% |
| U:2.7% | V:1.1% | W:2.2% | X:0.2% |
| Y:1.9% | Z:0.1% | | |

U.S. PATENT DOCUMENTS

| | | | | |
|---|---|---|---|---|
| 6,080,062 | A | 6/2000 | Olson | |
| 6,168,521 | B1 | 1/2001 | Luciano et al. | |
| 6,241,246 | B1 * | 6/2001 | Guttin et al. | 273/139 |
| 6,428,412 | B1 * | 8/2002 | Anderson et al. | 463/9 |
| 6,497,408 | B1 | 12/2002 | Walker et al. | |
| 6,773,345 | B2 | 8/2004 | Walker et al. | |

OTHER PUBLICATIONS

Wheel of Fortune Game Show as described in The Encyclopedia of TV Game Shows, 3rd ed, by Dave Schwartz, Steve Ryan and Fred Wostbrock, copyright 1999, pp. 250-252.*

Chip Brown, Austin American-Statesman, May 28, 1998, Copyright 1998 The Austin American-Statesman, 2 Pages.

* cited by examiner

APPLE
ORANGE
BANANA
PEAR

FIG. 1

Barbara,

Will you be my Valentine?

Carl

FIG. 2

CORN ON THE COB
PIECE OF PIE
LEG OF LAMB
CUP OF COFFEE
FRENCH FRIES

FIG. 3

| | | | |
|---|---|---|---|
| A:7.7% | B:1.7% | C:2.6% | D:4.3% |
| E:12.4% | F:2.4% | G:2.1% | H:5.7% |
| I:7.3% | J:0.1% | K:0.6% | L:3.4% |
| M:2.9% | N:7.4% | O:7.8% | P:2.1% |
| Q:0.1% | R:6.0% | S:6.0% | T:9.2% |
| U:2.7% | V:1.1% | W:2.2% | X:0.2% |
| Y:1.9% | Z:0.1% | | |

| Outcome | Probability |
|---|---|
| ABDIR | 5.9458E-05 |
| BCDIR | 2.00767E-05 |
| BDEIR | 9.57505E-05 |
| BDFIR | 1.85324E-05 |
| BDGIR | 1.62158E-05 |
| BDHIR | 4.40143E-05 |
| BDIJR | 7.72181E-07 |
| BDIKR | 4.63309E-06 |
| BDILR | 2.62542E-05 |
| BDIMR | 2.23933E-05 |
| BDINR | 5.71414E-05 |
| BDIOR | 6.02301E-05 |
| BDIPR | 1.62158E-05 |
| BDIRS | 4.63309E-05 |
| BDIRT | 7.10407E-05 |
| BDIRU | 2.08489E-05 |
| BDIRV | 8.49399E-06 |
| BDIRW | 1.6988E-05 |
| BDIRX | 1.54436E-06 |
| BDIRY | 1.46714E-05 |
| BDIRZ | 7.72181E-07 |

Total 0.000622378

FIG. 12 prize = price x payout / probability

FIG. 13

Probabilities

| | |
|---|---|
| THE | 0.155412074357803 |
| QUICK | 0.000008060227341 |
| BROWN | 0.002118508235895 |
| FOX | 0.002534116264814 |
| JUMPS | 0.000025201750409 |
| OVER | 0.014104168191341 |
| LAZY | 0.000223480893559 |
| DOG | 0.036521996566732 |

FIG. 14

$1 $18,610 $71 $59 $5,952 $11 $67 $4

THE QUICK BROWN FOX JUMPS OVER A LAZY DOG.

FIG. 15

$1 $5,000 $72 $64 $5,000 $11 $1,178 $4

THE QUICK BROWN FOX JUMPS OVER A LAZY DOG.

FIG. 16

$$\text{payout} = 60\% \times p_i^k \Big/ \sum_{1 \le j \le 8} p_j^k$$

FIG. 17 k = .5

| | | | | | | | |
|---|---|---|---|---|---|---|---|
| $4 | $513 | $32 | $29 | $290 | $12 | $98 | $8 |
| THE | QUICK | BROWN | FOX | JUMPS | OVER | A LAZY | DOG. |

FIG. 18 k = .3

| | | | | | | | |
|---|---|---|---|---|---|---|---|
| $3 | $2,601 | $53 | $46 | $1,171 | $14 | $254 | $7 |
| THE | QUICK | BROWN | FOX | JUMPS | OVER | A LAZY | DOG. |

FIG. 19 k = .1

| | | | | | | | |
|---|---|---|---|---|---|---|---|
| $1 | $10,521 | $70 | $59 | $3,771 | $13 | $529 | $5 |
| THE | QUICK | BROWN | FOX | JUMPS | OVER | A LAZY | DOG. |

FIG. 20

| | | | | | | | |
|---|---|---|---|---|---|---|---|
| $1 | $20,800 | $70 | $59 | $3,771 | $13 | $529 | $5 |
| THE | QUICK | BROWN | FOX | JUMPS | OVER | A LAZY | DOG. |

FIG. 21

| | |
|---|---|
| APPLE | $12 |
| BANANA | $5 |
| ORANGE | $71 |
| PEAR | $9 |
| PINEAPPLE | $167 |

FIG. 24

| | |
|---|---|
| CORN ON THE COB | $28 |
| PIECE OF PIE | $16 |
| LEG OF LAMB | $123 |
| CUP OF COFFEE | $24 |
| FRENCH FRIES | $27 |

FIG. 25

$2.00

$29 $2 $19 $69

A CHAIN IS ONLY AS STRONG $3 $825 $44

AS ITS WEAKEST LINK.

A I L N O S Y

FIG. 26

| | | | | |
|---|---|---|---|---|
| $166 | $12 | $2,042 | $2 | $5 |
| A | ROLLING | STONE | GATHERS | NO MOSS. |

FIG. 27

| | | | |
|---|---|---|---|
| $68 | $3 | $394 | $10 |
| TOMORROW | IS | ANOTHER | DAY. |

FIG. 28

| | | | | |
|---|---|---|---|---|
| $792 | $3 | $19 | $32 | $6 |
| BEAUTY | IS | ONLY | SKIN | DEEP. |

FIG. 29

$10.00

$29 $2 $19 $69

A CHAIN IS ONLY AS STRONG $3 $825 $44

AS ITS WEAKEST LINK.

A D E K S T W

E P I T U W Y

B C E I O S T

D E I N R T U

H L N R S V W

FIG. 32

$2.00
A D E K S T W
ID #: 29384718

$2.00
E P I T U W Y
ID #: 29384718

$2.00
B C E I O S T
ID #: 29384718

FIG. 34

$29 $2 $19 $69
A CHAIN IS ONLY AS STRONG
$3 $825 $44
AS ITS WEAKEST LINK.
ID #: 29384718

FIG. 33

Food: HONEY $6

Animal: KITTEN $7

Music: BANJO $164

Person: MARK TWAIN $174

Phrase: PRETTY AS AS PICTURE $886

Call Letters: A D E H

L M N O

R S T W

FIG. 35

| | | |
|---|---|---|
| A: 9 | J: 1 | S: 4 |
| B: 2 | K: 1 | T: 6 |
| C: 2 | L: 4 | U: 4 |
| D: 4 | M: 2 | V: 2 |
| E: 12 | N: 6 | W: 2 |
| F: 2 | O: 8 | X: 1 |
| G: 3 | P: 2 | Y: 2 |
| H: 2 | Q: 1 | Z: 1 |
| I: 9 | R: 6 | ?: 2 |

FIG. 39

*FOODS AND BEVERAGES*

| | |
|---|---|
| BISCUIT | $2,557 |
| BREAD | $4 |
| BUTTER | $72 |
| CAKE | $2 |
| CHEESE | $154 |
| CHILI | $22 |
| CHIPS | $35 |
| COFFEE | $277 |
| GARLIC | $52 |
| HONEY | $7 |
| MUFFIN | $595 |
| MUSTARD | $970 |
| NUTMEG | $57 |
| SALAD | $8 |
| SYRUP | $29 |

*MUSIC*

| | |
|---|---|
| BANJO | $13 |
| CORNET | $18 |
| DRUM | $3 |
| FLUTE | $7 |
| GUITAR | $22 |
| TRUMPET | $2,061 |
| VIOLIN | $49 |

*BIRDS AND ANIMALS*

| | | | |
|---|---|---|---|
| BEAGLE | $45 | SHARK | $23 |
| CANARY | $104 | SHEEP | $13 |
| COUGAR | $57 | SKUNK | $164 |
| COYOTE | $71 | SNAKE | $6 |
| CROW | $3 | TIGER | $2 |
| EAGLE | $3 | TURTLE | $43 |
| GERBIL | $40 | WASP | $3 |
| GOOSE | $5 | WEASEL | $36 |
| HORNET | $18 | WHALE | $9 |
| JAGUAR | $165 | WOLF | $4 |
| KITTEN | $54 | ZEBRA | $9 |
| LADYBUG | $4,387 | | |
| LEOPARD | $278 | | |
| LIZARD | $62 | | |
| MONKEY | $158 | | |
| MOOSE | $7 | | |
| PARROT | $52 | | |
| PIGEON | $23 | | |
| PYTHON | $186 | | |
| RABBIT | $117 | | |
| RACCOON | $2,700 | | |
| SALMON | $46 | | |

*PEOPLE*

| | |
|---|---|
| ACTOR | $4 |
| BOXER | $10 |
| DANCER | $23 |
| DOCTOR | $77 |
| FARMER | $85 |
| FIREMAN | $301 |
| MAYOR | $9 |
| PILOT | $5 |
| PLUMBER | $3,210 |
| STUDENT | $696 |
| TAILOR | $10 |
| TEACHER | $495 |
| UMPIRE | $54 |

*PLANTS AND FLOWERS*

| | |
|---|---|
| BIRCH | $25 |
| CYPRESS | $7,807 |
| DAISY | $7 |
| MAPLE | $9 |
| ORCHID | $77 |
| REDWOOD | $1,639 |
| TULIP | $9 |
| VIOLET | $18 |
| WILLOW | $628 |

*FRUITS, VEGETABLES, AND NUTS*

| | |
|---|---|
| APPLE | $20 |
| APRICOT | $439 |
| BANANA | $239 |
| CABBAGE | $7,748 |
| CARROT | $52 |
| CASHEW | $129 |
| CHERRY | $290 |
| GRAPE | $5 |
| LEMON | $4 |
| LETTUCE | $1,357 |
| OLIVE | $3 |
| ONION | $6 |
| ORANGE | $10 |
| PEACH | $14 |
| PEANUT | $23 |
| PECAN | $6 |
| PEPPER | $1,552 |
| POTATO | $86 |
| PUMPKIN | $33,489 |
| RADISH | $41 |
| TOMATO | $86 |
| TURNIP | $42 |
| WALNUT | $58 |

FIG. 40

| | |
|---|---|
| $2: 50% | $12: 60% |
| $3: 51% | $13: 61% |
| $4: 52% | $14: 62% |
| $5: 53% | $15: 63% |
| $6: 54% | $16: 64% |
| $7: 55% | $17: 65% |
| $8: 56% | $18: 66% |
| $9: 57% | $19: 67% |
| $10: 58% | $20: 68% |
| $11: 59% | |

FIG. 45

Please Insert $5

FIG. 48

Jane($16),

Will($6) you($6) accompany($303) me to the Christmas($60) party($14) this($5) Friday($16)?

Sincerely($60),

Tom($5)

You win a total of $10!

A D H I M O S T U W

FIG. 49

$2 $608 $4 $2

You are cordially invited to attend a $3 $2 $2 $2 supper at the home of Lana Swan on the $4 $3 evening of August 5, 2004 at 7:00 p.m.

A D H I M O S T U W $2 $7 $231 $28,820
SUSAN, GOOD LUCK PLAYING $3 $14 $14
THAT WORD GAME.

$27 $2,508 $3
YOUR HUSBAND, BOB

DRAW # 927384 $2.00

4:44 PM, MAY 5, 2005

| | Odds | Prize |
|---|---|---|
| THAT | 12.1 | $3 |
| BOB | 14.2 | $3 |
| GOOD | 45.4 | $7 |
| SUSAN | 84.7 | $10 |
| GAME | 137.6 | $14 |
| WORD | 153.7 | $14 |
| YOUR | 262.4 | $27 |
| LUCK | 3,146.8 | $231 |
| HUSBAND | 114,512.7 | $2,508 |
| PLAYING | 371,678.0 | $28,820 |

Overall Odds: 5.1

_ORN_REA_ (BCD)

_OUN_ AT _EART (GHY)

_U_ _LE _U_ (BGM)

Answers: CORNBREAD, YOUNG AT HEART, BUBBLE GUM

FIG. 59

Draw Date: September 18, 2005

PUZZLES

1. _ R E E N
2. _ E S _
3. _ A N _ U E T
4. _ A _ _ E

Answers: GREEN, DESK, BANQUET, BADGE

FIG. 60

Prize Table

Two Puzzles: $4

Three Puzzles: $50

Four Puzzles: $500

| | | | | | | | |
|---|---|---|---|---|---|---|---|
| B | TUBA | CDM | COMEDIAN | DMY | MELODY | HV | SHOVEL |
| BC | BISCUIT | CDP | POSTCARD | DP | LEOPARD | HW | WHALE |
| BCD | CORNBREAD | CDY | COURTYARD | DPY | EYEDROPS | HX | HOUSTON, TEXAS |
| BCG | CABBAGE | CF | COFFEE | DQ | SQUID | HY | HONEY |
| BCH | BENCH | CG | COUGAR | DV | DOVE | HZ | HORIZON |
| BCM | COMB | CGH | STAGECOACH | DW | LAW AND ORDER | J | JEANS |
| BCP | BUTTERCUP | CGM | MAGICIAN | DX | TUXEDO | JM | JAM |
| BCY | BICYCLE | CGP | STAGE PRESENCE | DY | DAISY | JP | JALAPENO |
| BD | BLUEBIRD | CGY | GROCERY STORE | DZ | LIZARD | JY | JELLY |
| BDG | BADGE | CH | CHOCOLATE | F | FLUTE | K | KITTEN |
| BDH | HEADBAND | CHM | CHAMELEON | FG | GOLF | KM | MILK |
| BDM | BADMINTON | CHP | PEACH | FH | SHERIFF | KP | PARAKEET |
| BDP | BEDSPREAD | CHY | CHERRY | FP | PROFESSOR | KY | KEY |
| BDY | BARNYARD | CJ | JUICE | FY | FIREFLY | M | LEMON |
| BF | FOOTBALL | CK | CRACKER | G | GREEN | MF | MUFFIN |
| BG | BEAGLE | CM | CINNAMON | GH | ENOUGH IS ENOUGH | MP | UMPIRE |
| BGH | NEIGHBOR | CMP | POLICEMAN | GHM | MOONLIGHT | MPY | PLAYROOM |
| BGM | BUBBLE GUM | CMY | MOTORCYCLE | GHP | SPAGHETTI | MQ | MOSQUITO |
| BGP | BAGPIPES | CP | APRICOT | GHY | YOUNG AT HEART | MV | MOVIE |
| BGY | BIOLOGY | CPY | CYPRESS | GJ | JUG | MW | WATERMELON |
| BH | BATHROBE | CQ | CROQUET | GK | KANGAROO | MX | MIXER |
| BHM | THIMBLE | CV | CARNIVAL | GM | NUTMEG | MY | MAYONNAISE |
| BHP | PAINTBRUSH | CW | CLOWN | GMP | PILGRIM | MZ | MOISTURIZER |
| BHY | HONEYBEE | CX | EXOTIC CRUISE | GMY | GYMNAST | P | PIANO |
| BJ | BANJO | CY | COYOTE | GP | GRAPE | PQ | QUINTUPLETS |
| BK | BOOK | CZ | ZINC | GPY | EGYPT | PV | ENVELOPE |
| BM | TROMBONE | D | SALAD | GQ | SQUIRT GUN | PW | WASP |
| BMP | PLUMBER | DF | DAFFODIL | GV | GLOVE | PX | SEXTUPLETS |
| BMY | STATUS SYMBOL | DG | GOLD | GW | WIG | PY | SYRUP |
| BP | PEBBLE | DGH | DAUGHTER | GX | STRONG AS AN OX | PZ | PIZZA |
| BPY | RASPBERRY | DGM | MARIGOLD | GY | GRAY | Q | SQUIRREL |
| BQ | BANQUET | DGP | PUDDING | GZ | LOZENGE | QY | STAR QUALITY |
| BV | BEAVER | DGY | STAND YOUR GROUND | H | SHOE | V | OLIVE |
| BW | BOWL | DH | RADISH | HJ | TROJAN HORSE | VY | IVY |
| BX | BOX | DHM | THUNDERSTORM | HK | SHARK | W | WALNUT |
| BY | RUBY | DHP | DOLPHIN | HM | HAMMER | WY | YELLOW |
| BZ | ZEBRA | DHY | THURSDAY | HMP | SHAMPOO | X | TAXI |
| C | LICORICE | DJ | JUDO | HMY | HONEYMOON | XY | LUXURY LINER |
| CD | ANACONDA | DK | DESK | HP | ELEPHANT | Y | LILY |
| CDG | SITTING ON CLOUD NINE | DM | MUSTARD | HPY | PYTHON | YZ | LAZY SUSAN |
| CDH | ORCHID | DMP | DIMPLE | HQ | SQUASH | Z | ZOO |

FIG. 63

| | Puzzle 1 | Puzzle 2 | Puzzle 3 | Puzzle 4 |
|---|---|---|---|---|
| Function 1: | $X_1$ | $X_2X_3$ | $X_4X_5$ | $X_1X_2X_4$ |
| Function 2: | $X_1$ | $Y_1$ | $X_2Y_2$ | $X_1X_2X_3$ |
| Function 3: | $X_1$ | $Y_1$ | $X_1X_2X_3$ | $X_2X_3X_4$ |
| Function 4: | $Y_1$ | $X_1Y_2$ | $X_2$ | $X_1Y_3$ |
| Function 5: | $Y_1$ | $Y_2$ | $X_1Y_3$ | $X_1Y_4$ |
| Function 6: | $Y_1$ | $Y_2$ | $Y_3$ | $Y_4$ |

FIG. 64

| Draw | Return |
|---|---|
| Class 1 | $7.7857142857w_1 + 0.3571428571w_2 + 2.0w_3 + 0w_4 + 0w_5 + 0w_6$ |
| Class 2 | $1.0571428571w_1 + 0.6964285714w_2 + 1.1589285714w_3 + 0.2321428571w_4 + 0w_5 + 0w_6$ |
| Class 3 | $0.1071428571w_1 + 0.6792091837w_2 + 0.3258928571w_3 + 0.5931122449w_4 + 0.2053571429w_5 + 0.4285714286w_6$ |
| Class 4 | $0w_1 + 0.3405612245w_2 + 0.18750w_3 + 0.8080357143w_4 + 0.8214285714w_5 + 2.6428571429w_6$ |
| Class 5 | $0w_1 + 0.1785714286w_2 + 0.1250w_3 + 0.4553571429w_4 + 1.6642857143w_5 + 10.3142857143w_6$ |
| Class 6 | $0w_1 + 0w_2 + 0w_3 + 0w_4 + 0.7142857143w_5 + 29.4285714286w_6$ |

FIG. 65

$$0 \le w_i \le 1,\ 1 \le i \le 6$$

$$w_1 + w_2 + w_3 + w_4 + w_5 + w_6 = 1$$

$$7.7857142857 w_1 + 0.3571428571 w_2 + 2.0 w_3 + 0 w_4 + 0 w_5 + 0 w_6 = R$$

$$1.0571428571 w_1 + 0.6964285714 w_2 + 1.1589285714 w_3 + 0.2321428571 w_4 + 0 w_5 + 0 w_6 = R$$

$$0.1071428571 w_1 + 0.6792091837 w_2 + 0.3258928571 w_3 + 0.5931122449 w_4 + 0.2053571429 w_5 + 0.4285714286 w_6 = R$$

$$0 w_1 + 0.3405612245 w_2 + 0.18750 w_3 + 0.8080357143 w_4 + 0.8214285714 w_5 + 2.6428571429 w_6 = R$$

$$0 w_1 + 0.1785714286 w_2 + 0.1250 w_3 + 0.4553571429 w_4 + 1.6642857143 w_5 + 10.3142857143 w_6 = R$$

$$0 w_1 + 0 w_2 + 0 w_3 + 0 w_4 + 0.7142857143 w_5 + 29.4285714286 w_6 = R$$

FIG. 66

$R = 54.77\%$
$w_1 = 1.29297\%$
$w_2 = 40.07980\%$
$w_3 = 15.19254\%$
$w_4 = 33.94179\%$
$w_5 = 7.82176\%$
$w_6 = 1.67113\%$

FIG. 67

Draw Date: September 18, 2005

The prize for matching all 4 puzzles is $400.

PUZZLES

1. _ R E E N

2. _ E S _

3. _ A N _ U E T

4. _ A _ _ E

Answers: GREEN, DESK, BANQUET, BADGE

| | |
|---|---|
| MNOY??# | 0.000000803620249 |
| MNOYY?? | 0.000000005997166 |
| MNOOY?? | 0.000000041980162 |
| MNNOY?? | 0.000000029985830 |
| MMNOY?? | 0.000000005997166 |
| KNOY??# | 0.000000401810125 |
| KNOYY?? | 0.000000002998583 |
| KNOOY?? | 0.000000020990081 |
| KNNOY?? | 0.000000014992915 |
| KMOY??# | 0.000000133936708 |
| KMOYY?? | 0.000000000999528 |
| KMOOY?? | 0.000000006996694 |
| KMNY??# | 0.000000100452531 |
| KMNYY?? | 0.000000000749646 |
| KMNO??# | 0.000000401810125 |
| KMNOY?# | 0.000001607240499 |
| KMNOY?? | 0.000000011994332 |
| KMNOYY? | 0.000000011994332 |
| KMNOO?? | 0.000000020990081 |
| KMNOOY? | 0.000000083960325 |
| KMNNY?? | 0.000000003748229 |
| KMNNO?? | 0.000000014992915 |
| KMNNOY? | 0.000000059971660 |
| KMMOY?? | 0.000000000999528 |
| KMMNY?? | 0.000000000749646 |
| KMMNO?? | 0.000000002998583 |
| KMMNOY? | 0.000000011994332 |
| ENOY??# | 0.000004821721496 |

| | |
|---|---|
| ENOYY?? | 0.000000035982996 |
| ENOOY?? | 0.000000251880974 |
| ENNOY?? | 0.000000179914981 |
| EMOY??# | 0.000001607240499 |
| EMOYY?? | 0.000000011994332 |
| EMOOY?? | 0.000000083960325 |
| EMNY??# | 0.000001205430374 |
| EMNYY?? | 0.000000008995749 |
| EMNO??# | 0.000004821721496 |
| EMNOY?# | 0.000019286885982 |
| EMNOY?? | 0.000000143931985 |
| EMNOYY? | 0.000000143931985 |
| EMNOO?? | 0.000000251880974 |
| EMNOOY? | 0.000001007523895 |
| EMNNY?? | 0.000000044978745 |
| EMNNO?? | 0.000000179914981 |
| EMNNOY? | 0.000000719659925 |
| EMMOY?? | 0.000000011994332 |
| EMMNY?? | 0.000000008995749 |
| EMMNO?? | 0.000000035982996 |
| EMMNOY? | 0.000000143931985 |
| EKOY??# | 0.000000803620249 |
| EKOYY?? | 0.000000005997166 |
| EKOOY?? | 0.000000041980162 |
| EKNY??# | 0.000000602715187 |
| EKNYY?? | 0.000000004497875 |
| EKNO??# | 0.000002410860748 |

| | |
|---|---|
| EKNOY?# | 0.000009643442991 |
| EKNOY?? | 0.000000071965992 |
| EKNOYY? | 0.000000071965992 |
| EKNOO?? | 0.000000125940487 |
| EKNOOY? | 0.000000503761947 |
| EKNNY?? | 0.000000022489373 |
| EKNNO?? | 0.000000089957491 |
| EKNNOY? | 0.000000359829962 |
| EKMY??# | 0.000000200905062 |
| EKMYY?? | 0.000000001499292 |
| EKMO??# | 0.000000803620249 |
| EKMOY?# | 0.000003214480997 |
| EKMOY?? | 0.000000023988664 |
| EKMOYY? | 0.000000023988664 |
| EKMOO?? | 0.000000041980162 |
| EKMOOY? | 0.000000167920649 |
| EKMN??# | 0.000000602715187 |
| EKMNY?# | 0.000002410860748 |
| EKMNY?? | 0.000000017991498 |
| EKMNYY? | 0.000000017991498 |
| EKMNO?# | 0.000009643442991 |
| EKMNO?? | 0.000000071965992 |
| EKMNOY# | 0.000009643442991 |
| EKMNOY? | 0.000000287863970 |
| EKMNOYY | 0.000000071965992 |
| EKMNOO? | 0.000000503761947 |
| EKMNOOY | 0.000000503761947 |

| | |
|---|---|
| EKMNN?? | 0.000000022489373 |
| EKMNNY? | 0.000000089957491 |
| EKMNNO? | 0.000000359829962 |
| EKMNNOY | 0.000000359829962 |
| EKMMY?? | 0.000000001499292 |
| EKMMO?? | 0.000000005997166 |
| EKMMOY? | 0.000000023988664 |
| EKMMN?? | 0.000000004497875 |
| EKMMNY? | 0.000000017991498 |
| EKMMNO? | 0.000000071965992 |
| EKMMNOY | 0.000000071965992 |
| EENOY?? | 0.000000395812959 |
| EEMOY?? | 0.000000131937653 |
| EEMNY?? | 0.000000098953240 |
| EEMNO?? | 0.000000395812959 |
| EEMNOY? | 0.000001583251834 |
| EEKOY?? | 0.000000065968826 |
| EEKNY?? | 0.000000049476620 |
| EEKNO?? | 0.000000197906479 |
| EEKNOY? | 0.000000791625917 |
| EEKMY?? | 0.000000016492207 |
| EEKMO?? | 0.000000065968826 |
| EEKMOY? | 0.000000263875306 |
| EEKMN?? | 0.000000049476620 |
| EEKMNY? | 0.000000197906479 |
| EEKMNO? | 0.000000791625917 |
| EEKMNOY | 0.000000791625917 |

FIG. 69

LOTTERY GAME BASED ON WORDS OR PHRASES

CROSS-REFERENCE TO RELATED APPLICATIONS

This application is a continuation-in-part of U.S. patent appiication Ser. No. 10/681,447, entitled "Word Based Lottery Game," filed Oct. 8, 2003 now U.S. Pat. No. 7,404,764, which is a continuation of U.S. patent application Ser. No. 10/662,736, entitled "Word Based Lottery Game," filed on Sep. 15, 2003 now U.S. Pat. No. 7,407,437, and claims the benefit of U.S. Provisional Patent Application Ser. No. 60/604,444, entitled "Lottery Game Based on Words or Phrases," filed on Aug. 25, 2004, the disclosures of which are hereby incorporated in their entirety by this reference.

BACKGROUND OF THE INVENTION

1. Field of the Invention

The invention generally relates to lottery systems for conducting lottery games and casino gaming systems. More particularly, the invention relates to lottery games that incorporate words and phrases into the play of the game.

2. Description of the Related Art

Many governments and/or gaming organizations sponsor wagering games known as lotteries. A typical lottery game entails players selecting permutations or combinations of numbers. This is followed by a "draw," wherein the lottery randomly selects a combination or permutation of numbered balls. Prizes are awarded based on the number of matches between a player's selections and the drawn numbers. Examples are the well-publicized, multi-million-dollar-jackpot lotteries popular throughout the world.

Lotteries have become an important source of income to governments as they shoulder much of the financial burden for education and other programs. As governments have grown more dependent on lotteries it has become a challenge to sustain public interest. One approach to invigorating lottery sales is to expand game content beyond traditional combination/permutation games. The new games may help keep current players, as well as draw in new players. One potential area to expand game content is that of word games.

SUMMARY OF THE INVENTION

The current invention is both a word game and a wagering game. In the current invention, words are provided by or are assigned to the player. The lottery or gaming organization assigns prize values to the words, individually or in groups. The lottery or gaming organization produces a set or sequence of letters. If the letters match a word or group of words in a predetermined way, the player is awarded the prize associated with that word or group of words.

In one embodiment, the invention is a word-based lottery game composed of a set of words where a word is a concatenation of characters; a draw, which is a random process for which an outcome is a concatenation of characters; a rule, which is a function that takes as input a word and the outcome from the draw and outputs a win/loss status; an assignment of prizes to some or all of the words or to certain subsets of words; and a plurality of entries, each entry having at least one word. The entries are paid for and recorded by the lottery organization prior to the draw. The game is consummated by the outcome of the draw being produced and disclosed.

BRIEF DESCRIPTION OF THE DRAWINGS

FIGS. 1-3 are examples of sets of words and phrases that could be used as a set of words according to the present invention.

FIG. 12 is a list of probabilities for outcomes that contain the letters in the word "BIRD."

FIG. 13 is an exemplary formula to set a prize.

FIG. 14 is the set of probabilities corresponding to a set of words.

FIG. 15 illustrates a set of prizes calculated using the probabilities of FIG. 14.

FIG. 16 illustrates another set of prizes calculated under the constraint that no prize exceeds $5,000.

FIG. 17 is a sample formula to assign payouts to individual words.

FIGS. 18-20 illustrate prizes based on payouts assigned by the formula in FIG. 17.

FIG. 21 illustrates the prize structure in FIG. 20 adjusted to yield a more exact return.

FIGS. 22-25 illustrate different styles of associating prizes with words.

FIG. 26 is a sample ticket according to one embodiment of the invention.

FIGS. 27-29 illustrate various examples of sets of words and prizes.

FIG. 32 illustrates a ticket that includes five draws.

FIG. 33 is a ticket that does not include a draw.

FIG. 34 illustrates multiple draws for the same game.

FIG. 35 illustrates a ticket with words and entire phrases assigned prizes.

FIG. 39 illustrates the frequency distribution of letters used in the game of Scrabble®.

FIG. 40 illustrates a prize table for a lottery game based on Scrabble®.

FIG. 45 is a progressive payout table according to the invention.

FIG. 48 illustrates a screen prompting a user to place a bet.

FIG. 49 illustrates a draw disclosed via a graphical user interface.

FIG. 59 illustrates examples of puzzles that can be used as content for this game.

FIG. 60 illustrates a ticket for an embodiment that uses puzzles.

FIG. 63 represents a database of word puzzles

FIG. 64 illustrates functions that produce solutions to puzzles based on permutations of letters.

FIG. 65 illustrates the returns for the different classes of draws expressed as linear combinations of weights on the functions in FIG. 64.

FIG. 66 is a system of constraints to determine the weights on the functions in FIG. 64.

FIG. 67 illustrates the solutions to the constraints in FIG. 66

DETAILED DESCRIPTION OF THE INVENTION

The current invention is a word-based lottery game composed of 4 parts: (1) a set of words, (2) a draw, which is a random process for which an outcome is a concatenation of characters, (3) a rule that decides whether or not a word is a winner based on the outcome of the draw, and (4) prizes assigned to some or all of the words or to subsets of words.

The first component of this invention is a set of words. A word is defined herein as a concatenation of characters. There are no restrictions on the words. For purposes of aesthetics, the words may be combined to have meaning, but that is extraneous to the mechanics of the game described herein. For example, the set of words may be a list related by a theme. Alternatively, the set of words may be a phrase, sentence, or paragraph. The player may select the words himself or the lottery may assign the words to him. As a compromise, the lottery may provide the player with a menu of predefined sets of words from which to choose. FIGS. 1 and 2 are examples of sets of words that could be used for this game.

In a variation, a word broadly defined as a set of characters could actually be a set of words separated by delimiters. A delimiter, such as a blank space, could itself be considered a character. FIG. 3 illustrates five phrases: "CORN ON THE COB," "PIECE OF PIE," "LEG OF LAMB" and "CUP OF COFFEE," "FRENCH FRIES." Each of these phrases could be treated as a "word" as defined for this invention: a concatenation of characters.

In another variation, a word may be defined to be a solution to a word puzzle. A word puzzle may be defined as an entity for which "missing letters" are indicated. For example, in FIG. 59 the first puzzle is -ORN-REA-. The completed puzzle is "CORNBREAD." The solution to this puzzle is BCD, as those are the missing letters. Similarly, the solution to the second puzzle is GHY for "YOUNG AT HEART," and the solution to the third puzzle is BGM for "BUBBLE GUM." The solutions to these puzzles, BCD, GHY, and BGM are concatenations of letters and may be considered words for the purposes of this invention.

The second component of this game is the draw. A draw is defined herein as a random process for which an outcome is a concatenation of characters. It is also required that the process be such that each possible outcome can be assigned a probability of occurrence.

Figure 4:
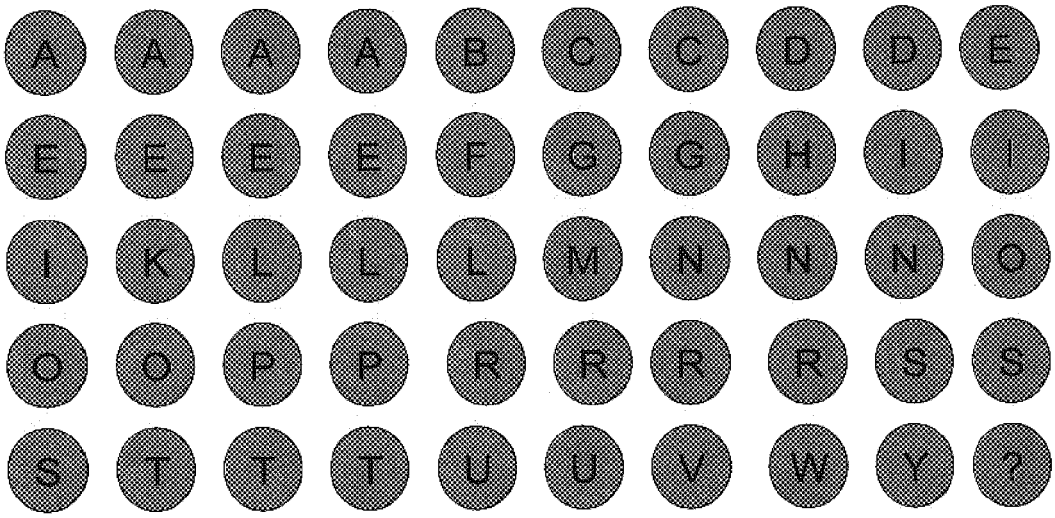
FIG. 4 illustrates balls identified with letters of the alphabet.
Figure 5:
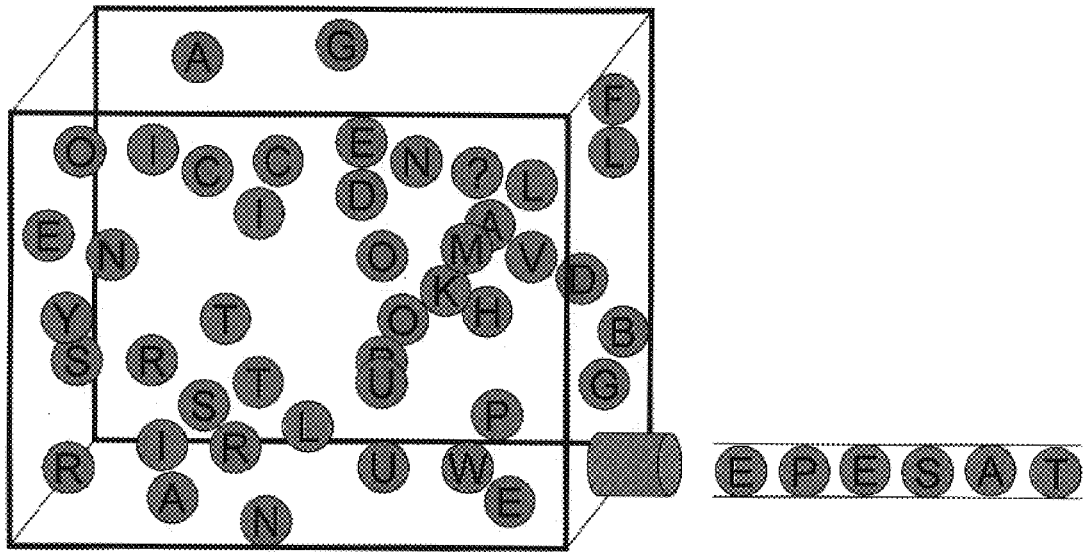
FIG. 5 illustrates the balls identified with letters being drawn from a hopper.

The process can be an actual physical process or a computerized process. For example, a subset could be drawn from set of objects identified with letters from the alphabet. FIG. 4 represents balls identified with letters of the alphabet. This particular distribution of the letters is such to very roughly represent their relative frequencies in the English language. For example, the letter "E" occurs more frequently than the letter "F." The question mark indicates a wildcard that can be substituted for any letter. (Notice that there is no J, Q, X, or Z in this distribution. However, the wildcard could be substituted.) The draw would consist of randomly selecting a subset of these balls, similar to the way numbered balls are drawn in lottery games. FIG. 5 illustrates a set of 6 such balls being produced from a hopper. The balls are mixed up in the machine by air and balls representing E, P, E, S, A, and T are released. The letters concatenated in alphabetical order AEEPST could be taken as the draw.

Figure 7:
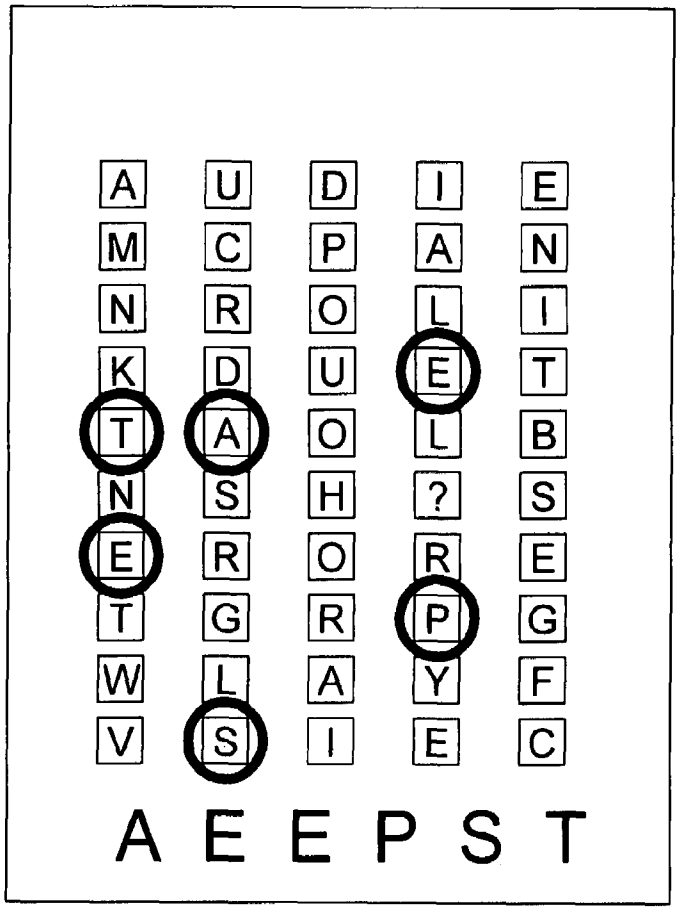
FIG. 7 illustrates a ticket issued according to a playslip.
Figure 6:
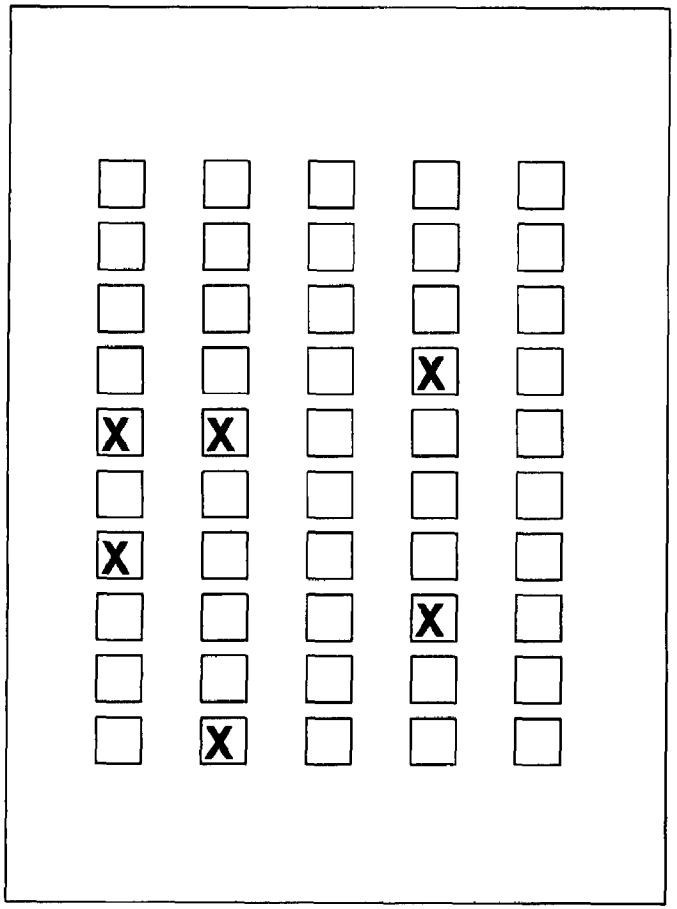
FIG. 6 illustrates a playslip.

Another embodiment of a draw is to have the player participate in randomly producing the outcome. For example, the player could mark cells on a playslip. FIG. 6 illustrates a playslip on which is a 10 by 5 grid of cells. The 50 cells will be identified with a random arrangement of a distribution of letters. For example, the distribution could be that on the lettered balls in FIG. 4: 4 A's, 1 B, 2C's, etc. The player selects 6 cells. Upon submitting his playslip, he receives a ticket as shown in FIG. 7 revealing an arrangement of the letters and wildcard. The outcome of the draw is the letters corresponding to the player's selections. In this example, the outcome is AEEPST. As the player did not know in advance how the distribution of letters would be arranged, this draw is a random process.

Figure 8:
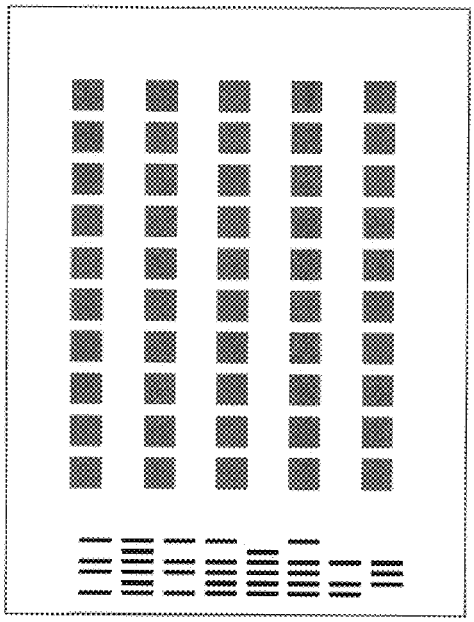
FIG. 8 illustrates a scratch ticket for the invention.
Figure 9:
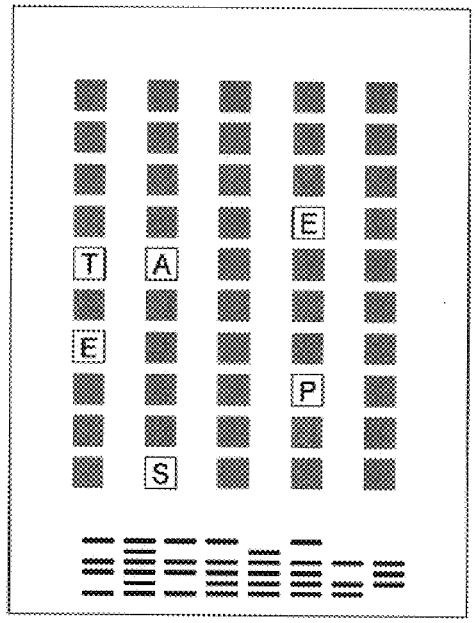
FIG. 9 illustrates the scratch ticket of FIG. 8 with some squares removed.

Similarly, a player could produce the draw with a scratch ticket. FIG. 8 illustrates a scratch ticket with a 10 by 5 grid of squares, each covered with latex. The squares conceal a random arrangement of a distribution of letters. The player scratches off 6 of the squares and the outcome of the draw is the letters the player scratched off, as illustrated in FIG. 9. In this case, the draw is A E E P S T.

Figures 10, 11:
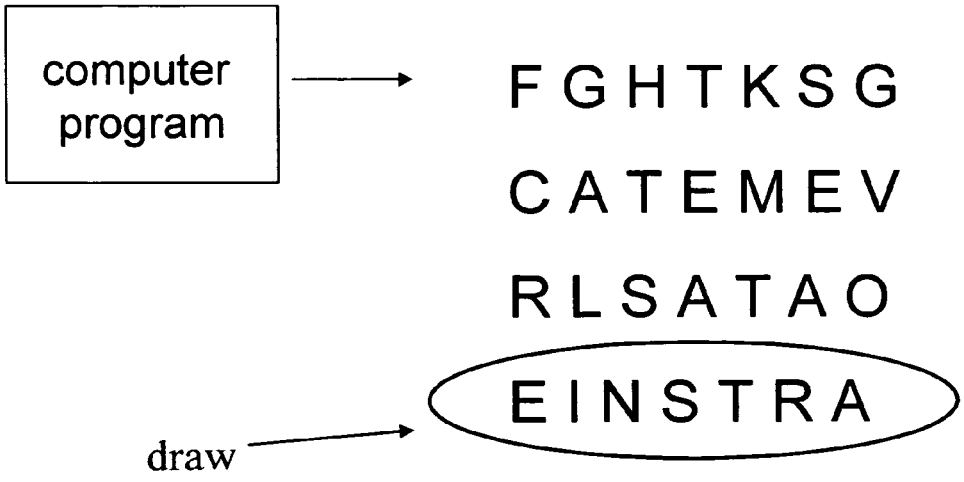
FIG. 10 illustrates a probability distribution assigned to the 26 letters of the alphabet.
FIG. 11 is an example of a draw with no repeated characters.

The outcome of a draw may be allowed to contain repeats or the characters may be required to be distinct. An example of a draw that excludes repetition of characters could be as follows: concatenations of 7 letters are randomly generated based on a probability distribution of letters described in FIG. 10. The letters are computer-generated one at a time based on the probability distribution via a random number generator until there are 7. As the generation of each letter is independent, this allows for the possibility of repetition within the set of 7 letters. The first generation of 7 letters that contains no repeats is taken to be the draw. FIG. 11 illustrates this scenario. A program is launched that generates random concatenations of 7 letters based on the distribution in FIG. 10. E I N S T R A is the first concatenation that contains no repeats, and it is taken as the draw.

Those skilled in the art of Mathematics can confirm that any of the afore-discussed processes are such that each possible outcome can be assigned a probability of occurrence. It should be noted that a draw could contain a constant set of letters. For example, a draw could consist of 12 letters wherein the letters E, I, N, R, S, T are automatically included and the remaining 6 letters are randomly selected.

The third component of this invention is a rule that assigns a word a win/loss status based on the draw. Most straightforwardly, the rule can be that a word "wins" if it can be formed using the characters contained in the draw. For example, if the word is "CAT" and the draw is A B C R T W, then the word "CAT" is conferred a win status as the letters "C," "A," and "T" are contained in the draw. The rule may be such that a letter in the outcome can be used as many times as needed to form the word. For example, the draw A C S T U V would confer the word "CACTUS" to be a winner, with the letter "C" in A C S T U V being used twice. In contrast, the rule may require an instance of a character in the draw be used at most once. In this case, the draw A C S T U V would confer "CACTUS" to be a loss, as "CACTUS" contains two "C"'s and the draw A C S T U V contains only one. However, the draw ACCSTU would confer "CACTUS" to be winner as there are two instances of the letter "C" in A C C S T U.

Another possibility for a rule is that the draw confers a word to be a winner if the word contains each of the letters in the draw. For example, if the word is "LANTERN" and the draw is A E N R T, "LANTERN" contains each of the letters in the draw, "A," "E," "N," "R," and "T." For this rule, "LANTERN" would be assigned a win status. Note that however the rule is defined does not affect the probability of an outcome, only whether or not the outcome confers a given word a winner.

The rule could be such so as to apply to an entire phrase, taking the phrase as a single concatenation of characters, the blank space being treated as a character. Consider the five phrases in FIG. 3. Suppose the draw comprises eight distinct letters from the 26 letters in the English alphabet. A blank space cannot be drawn. The rule for winning is that a phrase can be formed with the drawn letters ignoring the blank spaces and allowing a letter to be used as many times as needed. In this case, the draw BCEHONRT would confer "CORN ON THE COB" a winner, as the draw includes every character in "CORN ON THE COB," ignoring blank spaces.

The rule may be that a draw confers a word puzzle a winner if it contains the solution, i.e. the "missing letters." For example, the solutions to the puzzles in FIG. 59 are BCD, GHY, and BGM. The draw BCDFG would confer the puzzle -ORN-REA- ("CORNBREAD") a winner as it contains the solution BCD.

A rule that assigns each word a win/loss status based on the outcome of the draw, combined with the fact that each outcome of the draw can be assigned a probability, allows each word to be assigned a probability of winning. For example, suppose that a draw consists of five letters without repetition and is such that each possible outcome is assigned a probability. Furthermore, suppose the rule for winning is that a word can be formed with the draw using each letter in the draw as many times as needed. What is the probability that the word "BIRD" will win? By the laws of probability, it is the sum of the probabilities of the possible outcomes of the draw that confer "BIRD" to be a winner. FIG. 12 lists all such outcomes and corresponding probabilities. The probability that "BIRD" will win is the sum of these probabilities, 0.000622378. (The actual probabilities assigned to the outcomes depend on the specific nature of the draw.)

We have described a general outline for computing the probability that a word will win: Determine the outcomes that confer that word to be a winner, compute their probabilities, and total them. As there may be thousands or millions of outcomes that confer a word to be a winner, performing this calculation directly could require thousands or millions of computations. In general, this calculation need not be computed directly as techniques and formulas from algebra can be used. As an example we consider the following scenario: The draw consists of randomly generating sequences of 8 letters from the probability distribution in FIG. 10. The first sequence for which there are no repeats is taken to be the draw. The rule by which an outcome confers a word to be a winner is that the word can be formed using the drawn letters, using a letter as many times as needed. What is the probability that the word "HAPPY" will win? The problem can be formulated as follows: The experiment is that of randomly generating a sequence of 8 letters based on the probability distribution in FIG. 10. Let A be the event that letters "A", "H", "P", "Y" are included in the sequence and B be the event that the sequence contains no repeats. The probability that "HAPPY" will win is P(A/B), the probability of A given B. By the laws of probability $P(A/B)=P(A\cap B)/P(B)$. For x a letter of the alphabet let $p_x$ denote the probability assigned to x by the distribution in FIG. 10. From FIG. 10, $p_a=0.077$, $p_h=0.057$, $p_p=0.021$, and $p_y=0.019$. Enumerate the probabilities for the other 22 letters as $p_1, p_2, \ldots, p_{22}$. By the laws of probability, $P(A\cap B)$, the probability that the sequence contains "A", "H", "P", "Y" and that there are no repeats, is $8!\,\Sigma_{1<=i<j<k<l<=22}\, p_a p_h p_p p_y p_i p_j p_k p_l$, which simplifies to $0.07060882752\,\Sigma_{1<=i<j<k<l<=22}\, p_i p_j p_k p_l$ Recognizing that the expression $\Sigma_{1<=i<j<k<l<=22}\, p_i p_j p_k p_l$ is an elementary symmetric polynomial evaluated at $p_1, \ldots, p_{22}$, we employ the Newton-Girard formulas. (For a full description of Newton-Girard Formulas, see Eric W. Weisstein. "Newton-Girard Formulas." From MathWorld—A Wolfram Web Resource. http://mathworld.wolfram.com/Newton-GirardFormulas.html) Applying Newton-Girard formulas we get $P(A\cap B)=0.000814183208226838$. Similarly, using the laws of probability $P(B)=8!\,\Sigma_{1<=i<j<k<l<m<n<o<p<=22}\, p_i p_j p_k p_l p_m p_n p_o p_p$. This expression can also be computed using Newton-Girard formulas. This computation is 0.130646297. The probability of "HAPPY" winning is $P(A/B)=P(A\cap B)/P(B)=0.000814183208226838/0.130646297=0.006231965$ The fourth component of this invention is the prizes. Prize values are assigned to some or all of the words or subsets of the words. The prize values must be such that the game will return a set payout, or within an acceptable margin of error. For the case for which prizes are assigned to individual words, this is accomplished by the formula in FIG. 13, where the "price" is that of the game, the "payout" is that for an individual word (as opposed to the payout for the whole game), and "probability" is the probability that a word will win. As it has been noted, the fact that every outcome of the draw can be assigned a probability and that each word can be assigned a win/loss status, guarantees that each word can be assigned a probability of winning. To show how this formula is applied, consider a simple example. Suppose that the price of this game is \$2, the payout is set at 50%, and the "set of words" comprises one word: "BIRD," and that the probability of winning is 0.000622378. Applying the formula in FIG. 13, the prize for BIRD to the nearest dollar is \$1,607=\$2×0.50/0.000622378. Those skilled in the art of Mathematics can assert that this prize assignment will pay out 50%. (A player pays $2. He has a 0.000622378 chance of winning $1,607. His payout is $1,607×0.000622378/$2=50.0%.)

For the case where prizes are assigned to individual words, prizes must be assigned so that the payouts for the individual words total to the set payout for the game. The way in which payouts for the individual words are allocated is variable, but their total is constant. For example, suppose that the price is $2, the set payout for the game is 50%, the set of words is "HAPPY BIRTHDAY," a draw consists of 8 distinct letters, and the rule for winning is that a word wins if it can be formed with the letters contained in the draw allowing a letter to be used as many times as needed. Furthermore, suppose that the probabilities for winning "HAPPY" and "BIRTHDAY" are 0.006231965439 and 0.000007580920, respectively. Prize values must be assigned to these words. This can be done by assigning payouts to the two words in such a way that they add up to 50%. Most straightforwardly, the payouts for the individual words can be assigned equally. Assigning payouts of 25% to "HAPPY" and 25% to "BIRTHDAY" and using the formula in FIG. 13, the prize values are calculated as follows:

$80=$2×25%/0.00623196539, for HAPPY, and $65,955=$2×25%/0.000007580920, for BIRTHDAY.

If the word "HAPPY" is assigned the prize $80, and winnings for the word "HAPPY" will pay out 25% over time. Similarly, if "BIRTHDAY" is assigned the prize $65,955, winnings for the word BIRTHDAY will be 25% over time. The overall payout for the game is 25%+25%=50%.

However, the payouts for the individual words need not be allocated equally. For example, the lottery may desire that no prize exceed a certain threshold, such as $5,000. This can be accomplished by allocating less of the payout to the word "BIRTHDAY." Assigning payouts of 49% to "HAPPY" and 1% to "BIRTHDAY," the prizes are $157=$2×49%/0.00623196539, for "HAPPY," and $2,638=$2×1%/0.000007580920 for "BIRTHDAY."

As illustrated with the phrase "HAPPY BIRTHDAY," there are various ways in which the payouts can be allocated to the individual words, while keeping the set payout for the game constant. A general scheme for assigning prizes to individual words is: (1) determining how the payouts for the individual words are to be allocated, and (2) computing the prizes for the words based on the formula in FIG. 13.

There are various approaches to how the payouts should be allocated to the individual words. The simplest approach is to assign each word the same payout: the payout for the game divided by the number of words. For example, consider the set of words, "THE QUICK BROWN FOX JUMPS OVER A LAZY DOG". Furthermore suppose that the price is $1 and the payout for the game is 60%. Suppose the probabilities rounded to the $16^{th}$ decimal place for winning the words in the phrase "THE QUICK BROWN FOX JUMPS OVER A LAZY DOG" (excluding the word "A") are shown in FIG. 14. Assigning each word an equal payout of 7.5%, using the formula in FIG. 13 and rounding to the nearest dollar, the prizes are as indicated in FIG. 15.

It may be desired that prizes not to exceed a certain threshold. The payouts for the individual words can usually be adjusted to achieve this result. For example, the lottery may require that no prize exceed $5,000. In the example in FIG. 15, assigning equal payouts for the individual words results in the prizes for JUMPS and QUICK results being over $5,000. This can be remedied by assigning a prize value of $5,000 to QUICK and JUMPS and distributing the remainder of the payout to the remaining words. FIG. 16 illustrates this scheme. No prize exceeds $5,000 and the set payout for the game is 60%. (It should be noted that the payouts for the remaining words is not exactly equal. The payout for LAZY was adjusted so that the return is exactly 60.0% to the nearest $10^{th}$ of a percent.)

A more sophisticated approach for allocating payouts to words is to parameterize the allocation of the payouts by a real numbered parameter. The following is a description of this scheme. Given a set of words, the eight words with the least probabilities of winning are selected. Let $p_1, p_2, \ldots p_8$, be the probabilities of those words. Given a number k, the payout for an individual word is defined as in FIG. 17, where $p_i$ is the probability corresponding to the particular word. Those skilled in the art of Mathematics can verify that the total of these payouts is 60%. FIGS. 18 through 20 illustrate prize values assigned "THE QUICK BROWN FOX JUMPS OVER A LAZY DOG" using this formula for the values 0.5, 0.3, and 0.1 for k. Note that in general the lower the value of k, the greater the prize range. That is, the prize ranges can be lowered or increased by adjusting the values of k. Those skilled in the art of Mathematics and computing can verify that these schemes for assigning prizes to words can be automated. These and other schemes for apportioning payouts to words can result in some error due to rounding the prizes, such as to the nearest dollar. For example, in FIG. 20 the payout for these prize assignments turns out to be 55.8%, rather than exactly 60.0% as desired, because of rounding error. This error can be removed by adjusting one of the prizes. Changing the prize for "QUICK" in FIG. 20 from $10,521 to $20,800 results in a new prize structure in FIG. 21, the payout of which is 60.0% to the nearest 1/10 of a percent. In general, prize assignments can be tweaked to produce a more exact payout for the game.

Figure 23:
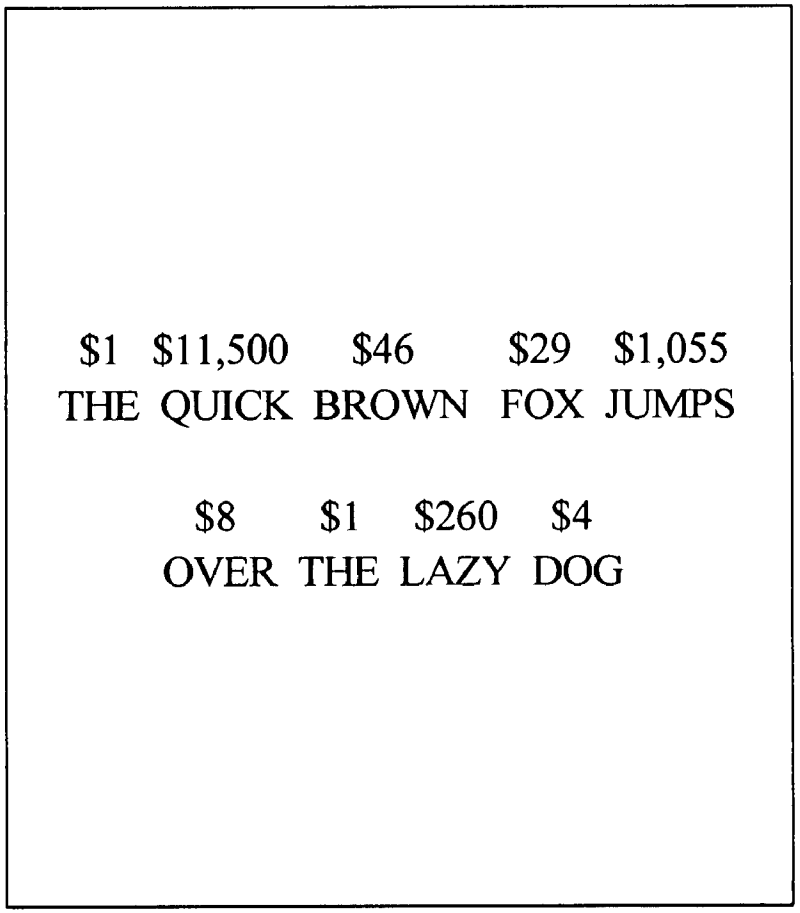
Figure 22:
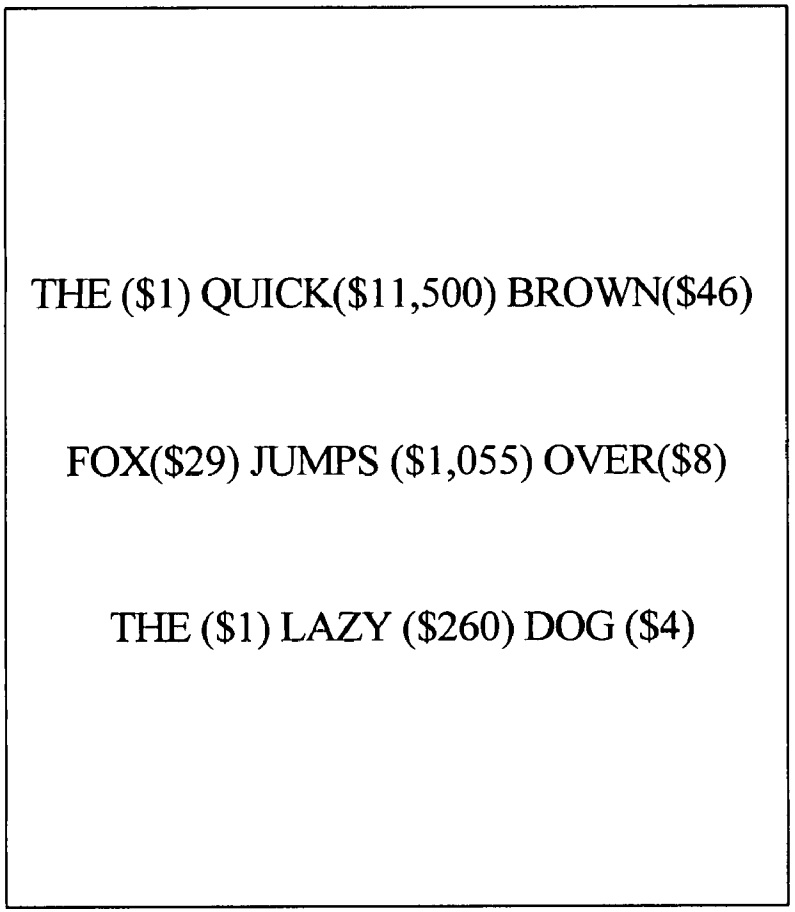

In this invention, the set of words and the assigned prizes may be memorialized on a ticket or displayed on an electronic screen. However, the words and prizes are memorialized, they must be displayed so that the assignment of prizes is clear. There are various styles for associating words and prizes. FIG. 22 illustrates a ticket where the prizes corresponding to the ticket are in parentheses. FIG. 23 illustrates a ticket for which the prizes are positioned above the corresponding words. FIGS. 24-25 illustrates a ticket in which the words and corresponding prizes are in parallel columns. (In FIG. 25 a "word," i.e. a concatenation of characters, is actually a phrase where blank spaces are part of the concatenation of characters.)

Another approach to assigning prizes is to assign prizes to subsets of words rather than to individual words. For example, prizes based on the number of words conferred a winner as opposed to specific prize values for specific words. Such an embodiment requires a system for distributing content to entries to ensure a certain return to the player. Such an embodiment will be discussed in detail later.

Having described the four basic components of this game: (1) a set of words, (2) a draw, (3) a rule for determining a winner, and (4) prizes, actual embodiments will now be described.

In one embodiment the price for entry is $2 and the payout is 60%. The draw is a set of 7 letters without repeats or wildcards. Outcomes are produced using the distribution of letters described in FIG. 10. The process of the draw is as follows: sets of 7 letters are computer-generated via a random number generator based on this probability distribution. The first set that contains no repeats is taken as the outcome of the draw. Those skilled in the art of Mathematics can verify that this method is such that every possible outcome can be assigned a probability of occurrence. For example, the probability that the outcome is A E I N R S T is 0.000387859. The rule by which a draw confers a word a winner is that the word can be formed using the letters in the draw, allowing a single letter to be used as many times as necessary. The price is $2 and the set payout for the game is 60%. The set of words is "A CHAIN IS ONLY AS STRONG AS ITS WEAKEST LINK." Prizes are assigned to words in such a way as to pay out 60% and the words and prizes are memorialized on a ticket as in FIG. 26. In this embodiment, the draw takes place at the time of the purchase. The random draw may be performed at the terminal producing the ticket or performed remotely and communicated to the terminal. The draw is printed on the same ticket as the play as illustrated in FIG. 26. In this example, the player is able to compose the words "IS" and "ONLY" with the letters in the draw: A I L N O S Y. He is awarded the prizes associated with these words, a total of: $2+$19=$21

The embodiment in the above paragraph was described using the set of words, "A CHAIN IS ONLY AS STRONG AS ITS WEAKEST LINK." In practice, the lottery may employ many sets of words, and the player is assigned a particular set at the time of purchase. FIGS. 27-29 illustrate various examples of sets of words and prize assignments.

Figure 31:
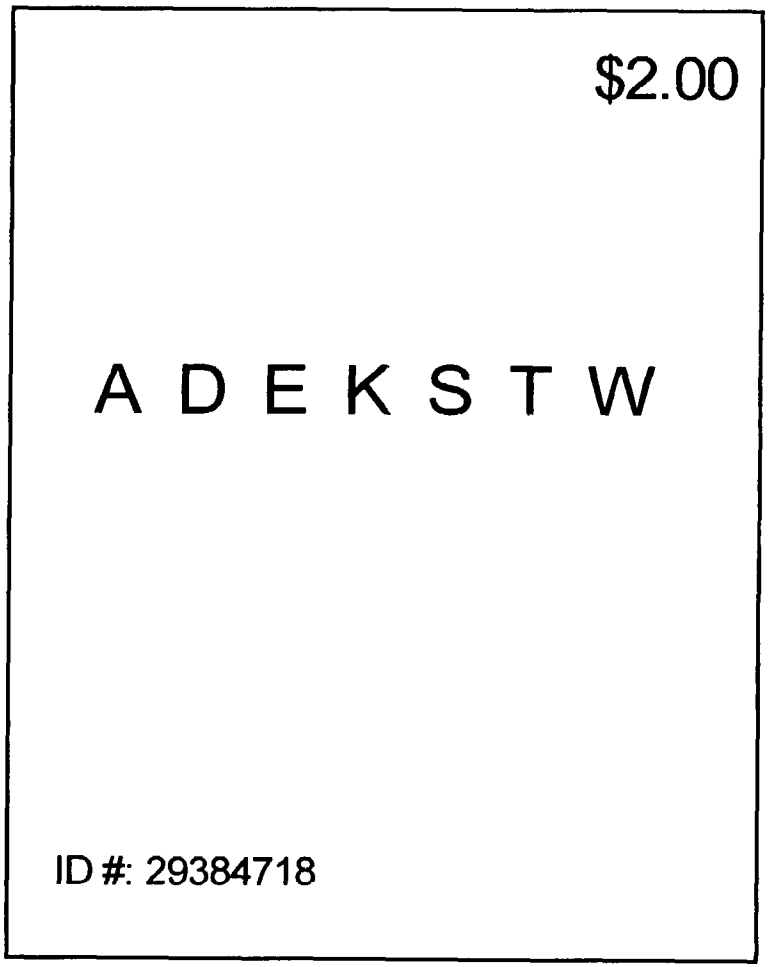
FIGS. 30-31 illustrate two tickets that comprise one game.
Figure 30:
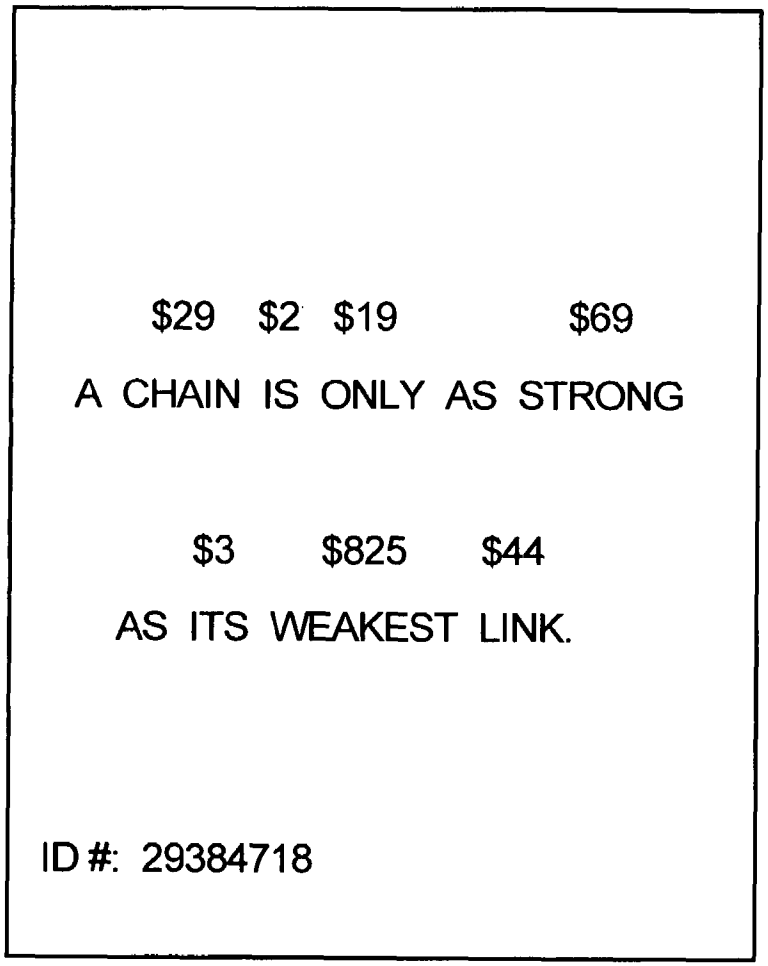

In a variation of the embodiment in the above paragraph the words with the assigned prizes and the draw can be on separate tickets. The player may be given a ticket with words and prizes as in FIG. 30. He gives this ticket to a retailer and purchases a second ticket that contains a random draw as in FIG. 31. The draw on the second ticket confers the winning word(s) on the first ticket. In the game illustrated in FIGS. 30 and 31, the player wins $825 as he is able to compose the word WEAKEST with the drawn letters A D E K S T W. ("E" is used twice, which is allowed by the particular rule for this embodiment.)

There are numerous variations and combinations of the embodiments discussed above. For example, the player could purchase a ticket with more than one draw on it as in FIG. 32. The ticket contains five random draws each of which is used for a separate game. The price is $10, 5 times the price for one game.

In another variation, the play could receive his play for free, but he would be required to purchase his draws. In FIG. 33, he is issued a ticket with the words and prizes for free, or for some fee. But he is required to purchase random draws. He purchases any number of random draws as he likes, as illustrated in FIG. 34.

Also, in any of these embodiments the draw could include a constant subset. For example, FIG. 35 illustrates a ticket for which words and phrases have been assigned prizes. Also on the ticket is a set of call letters. The letters E, L, N, R, S, and T are always included in the call letters. However, the remaining 6 letters are the result of a random draw. The player wins a prize if he can complete the associated word or phrase with the call letters. This is equivalent to the random draw comprising a set of six letters excluding E, L, N, R, S, and T and the rule for conferring a winner being that a word can be composed with these six letters excluding E, L, N, R, S, and T.

Figure 36:
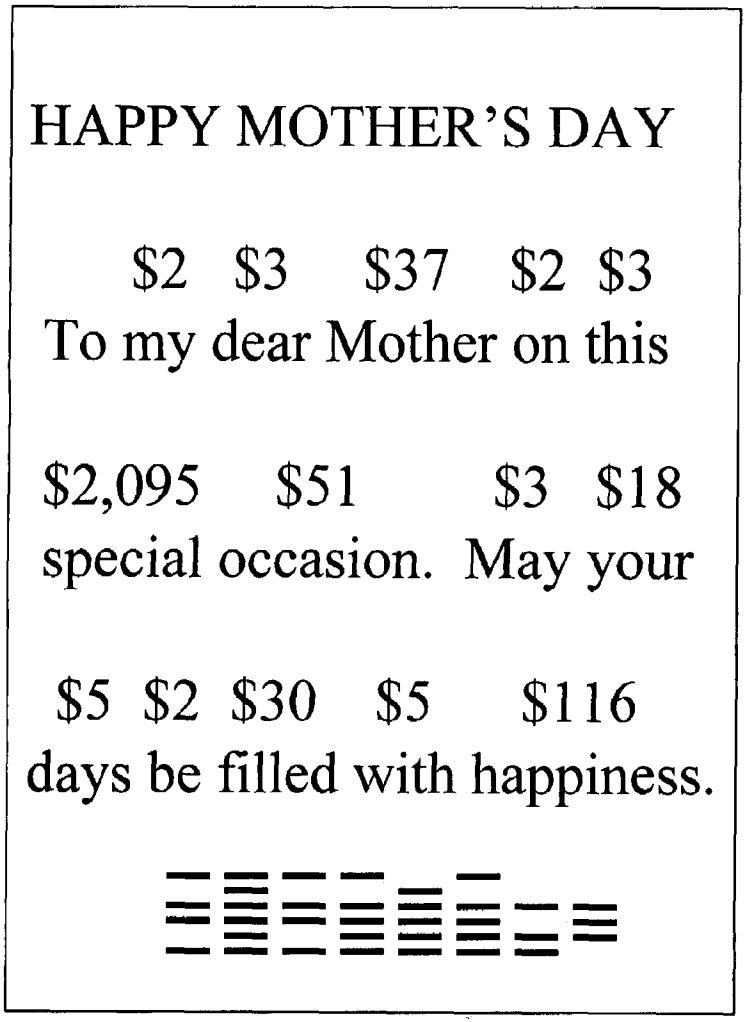
FIG. 36 illustrates an embodiment of an instant ticket according to the invention.
Figure 37:
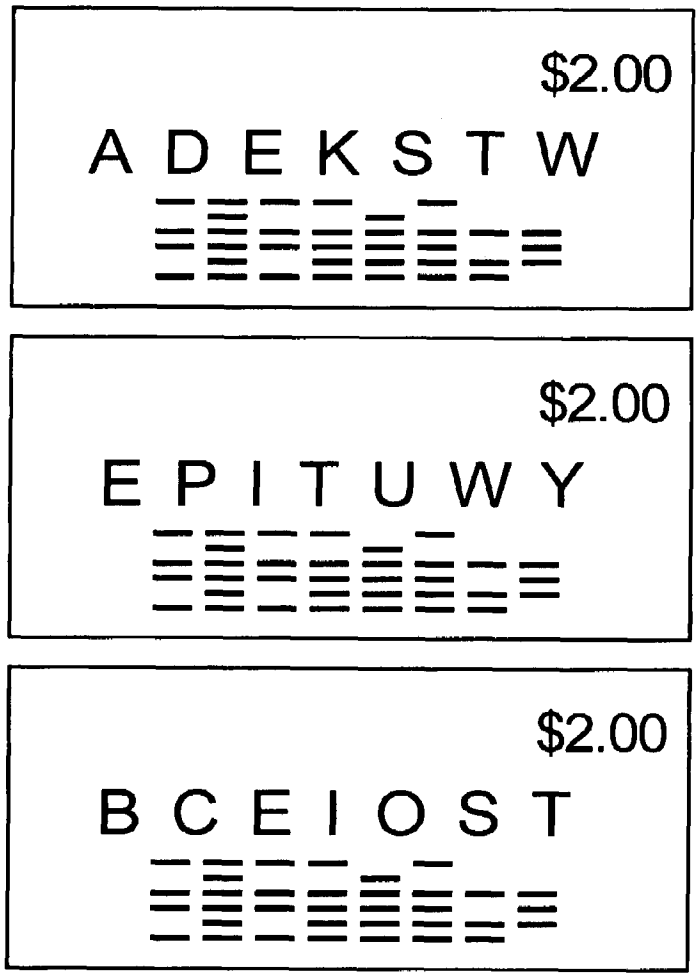
FIG. 37 illustrates several draws for the instant ticket of FIG. 36.

These embodiments can easily be adapted to instant or "scratch" tickets. FIG. 36 illustrates an instant ticket that embodies this invention. The instant ticket displays a set of words with assigned prizes and is made of a relatively thick material such as cardboard. The instant ticket may have relatively high production values such as color and artwork. Ordinarily, instant tickets are coated with a material such as latex that the player removes. However, this embodiment would require no such coating as there would be no need to conceal information. Instead, the player would purchase draws via a retailer. He pays to have his instant ticket scanned and receives a ticket with a draw, consisting of a randomly generated set of letters. Various examples of such draws are illustrated in FIG. 37. This draw would determine the winning words and prizes on his ticket. He could use this instant ticket to purchase as many draws as he likes.

Figure 38:
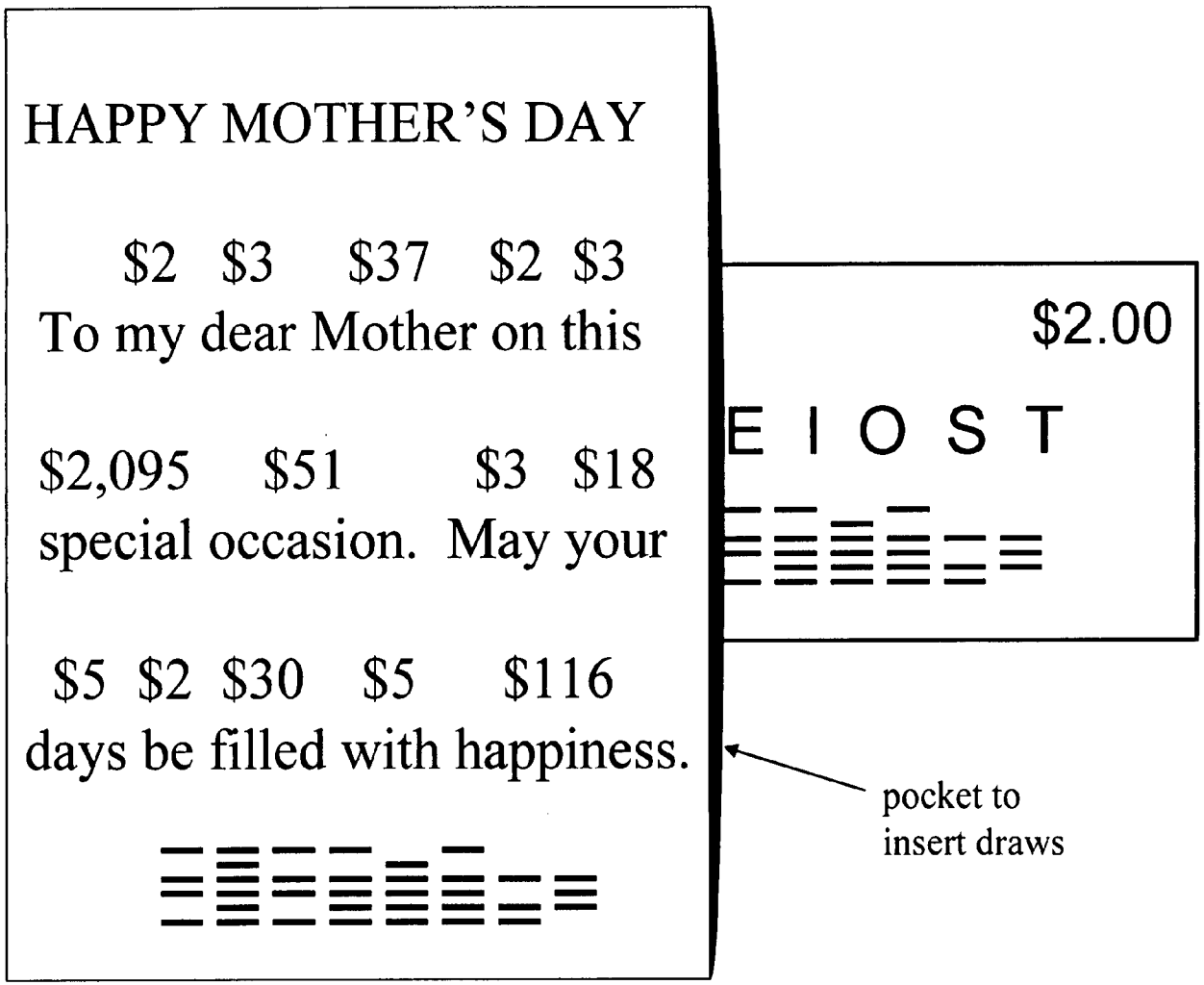
FIG. 38 illustrates an instant ticket with a pocket for storing draws.

This instant ticket could even feature a pocket for the player to store draws, so that he can play the game at his convenience as illustrated in FIG. 38. The instant ticket of FIG. 38 has two sides and may be manufactured similar to the ticket described above in FIG. 36. On the first side, it displays a set of words with assigned prizes. The first side and the second side form a pocket, into which the draws can be stored.

Figure 41:
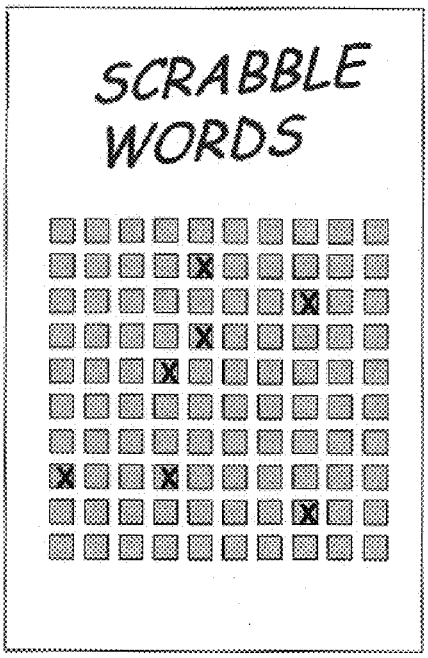
FIG. 41 illustrates a playslip for a lottery game based on Scrabble®.
Figure 42:
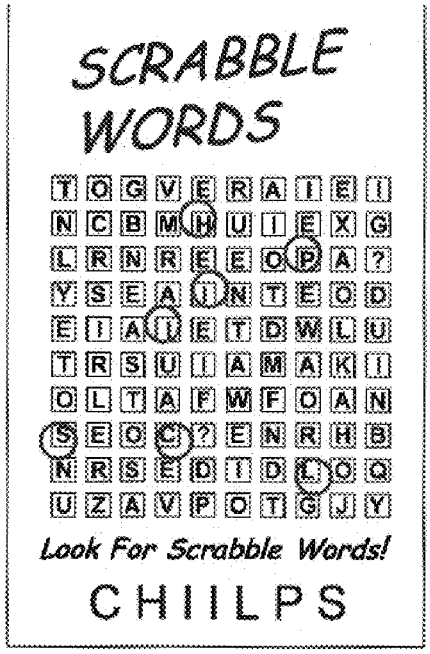
FIG. 42 illustrates a ticket of a lottery game based on Scrabble®.

In another embodiment, the player himself participates in producing the random draw. An example is an embodiment based on the word game Scrabble®. Scrabble® is based on the frequency distribution of letters and wildcards illustrated in FIG. 39, where a question mark "?" denotes a wildcard. The lottery provides the player with a prize table, as in FIG. 40. For example, the prize table could be part of the point-of-sale material or available via the Internet. The player is provided with a playslip as in FIG. 41 that displays a 10 by 10 grid of cells. The player marks 7 of the cells on the grid. For $2, the player submits his playslip and receives a ticket as illustrated in FIG. 42. Displayed on the ticket is a random arrangement of the Scrabble® distribution. The draw is the 7 letters and/or wildcard(s) on the ticket that correspond to the cells the player selected on the playslip. For example, the letters C H I I L P S on the ticket in FIG. 42 correspond to the cells the player selected on the playslip in FIG. 41. As the arrangement of the Scrabble® distribution on the ticket is random, this draw is equivalent to 7 letters and/or wildcards being randomly drawn from the Scrabble® distribution without replacement. Producing the draw in this manner satisfies the criteria for this invention that a draw to be a random process such that probabilities can be assigned to every possible outcome.

Having defined the draw for this embodiment, there must be a rule by which the draw confers a word to be a winner or not a winner. As there may be multiple occurrences of the same letter and/or wildcards in the draw, the rule for this embodiment for conferring a word a winner is that a word be formed from the drawn letters, not allowing a drawn character to be used more than once. For example, the draw AABNNST would confer the word BANANA to be a loser as it does not contain enough "A's." That is, BANANA cannot be formed with AABNNST without using an instance of "A" more than once. However, AAABNNS does confer BANANA a winner. Also, a wildcard can be substituted for any letter. For example, the draw AAB?NNS, where the question mark denotes a wildcard, confers BANANA to be a winner as the wildcard can be substituted for an "A." In the example in FIGS. 41 and 42, the player has randomly selected C H I I L P S. The words CHILI and CHIPS can be formed with these letters. Therefore, by the prize table in FIG. 40, the player is awarded $22+$35=$57.

The prize table for this embodiment in FIG. 40 is derived using the formula in FIG. 13. Prize values are assigned to each word in such a way that the total payout for the game is 70.0%. For example, consider the word "MONKEY." The prize for winning "MONKEY" is $158 as indicated in FIG. 40. We can compute the payout for "MONKEY" using the formula in FIG. 13. The probability of winning "MONKEY" comprises 109 mutually exclusive cases illustrated in FIG. 69. In FIG. 69, "?" stands for a wildcard, of which there are 2 in the distribution, and # stands for the letters excluding "M", "O", "N", "K", "E", "Y" and the wildcards of which there are 100−2−8−6−1−12−2−2=67. Computing the probability for any one of these cases is straightforward. For example, the probability of the draw being EKMNO?# is (12×1×2×6×8×2×67)/(100×99×98×97×96×95×94)=0.000009643442991, as there are 12 E's, 1 K, 2, M's, 6 N's, 8 O's, 2 Wildcards, and 67 of the of other letters. The probability of winning "MONKEY" is the total of the probabilities for these mutually exclusive cases, which is 0.000088744313874. By the formula in FIG. 13, the payout for the word MONKEY is $158×0.000088744313874/$2=0.70801%. The payouts for the other words in the prize table are computed similarly. The return for the game is obtained by adding the payouts for all of the words in the prize table, which turns out to be 70.0%

Figure 43:
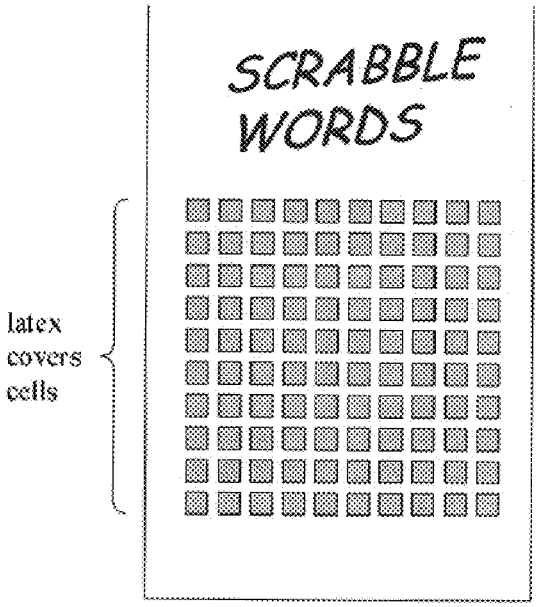
FIG. 43 illustrates an instant ticket based on Scrabble®.
Figure 44:
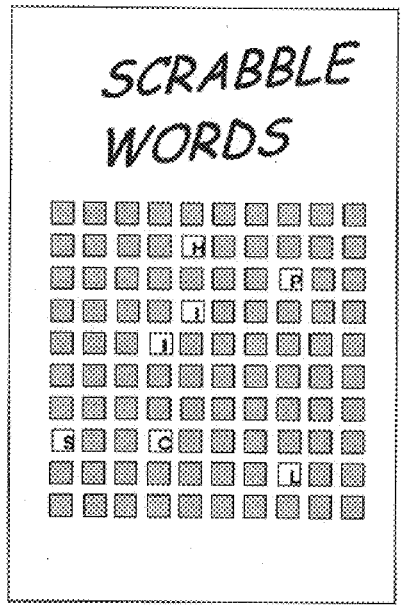
FIG. 44 illustrates an instant ticket with some squares scratched off.

This concept of a player producing the random draw could similarly be embodied with an instant ticket. A prize table as in FIG. 40 is provided to the player. For example, it could be part of the point-of-sale material, available via the Internet, or printed on the back of the instant ticket. The player pays $2 to purchase an instant ticket. FIG. 43 illustrates an instant ticket displaying a 10 by 10 grid of squares, each covered with latex. Behind the 100 squares is a random arrangement of the Scrabble® distribution (FIG. 39). To produce the draw, the player scratches off 7 of the squares. Technologies have been patented for game cards that for which players can make selections such as this. (See U.S. Pat. No. 5,997,044 and/or U.S. Pat. No. 6,533,276.) FIG. 44 illustrates the instant ticket in FIG. 43 with the squares having been scratched off by the player. As the letters and wildcards of the Scrabble® distribution are randomly arranged, the draw is equivalent to drawing 7 letters and/or wildcards from the Scrabble® distribution without replacement. In this case the player has scratched off the letters C H I I L P S, which confers the words CHILI and CHIPS to be winners. By the prize table in FIG. 40, the player wins $22+$35=$57.

An embodiment of this invention in which a player provides the words and controls some of the game parameters will now be described. In this embodiment, the player may wager what he likes in increments of dollars from $2 to $20. The payout is increased with the wager, as illustrated in FIG. 45. The draw is based on the probability distribution in FIG. 10 and consists of a fixed number of distinct letters. The way in which the distinct letters is produced is as follows: sequences of letters of a fixed size are randomly generated from the probability distribution until one occurs that contains no repeats. That sequence in alphabetical order is taken as the draw. The rule that confers a word a winner is that the word can be composed with the drawn letters, using a single letter as many times as necessary.

Figure 46:
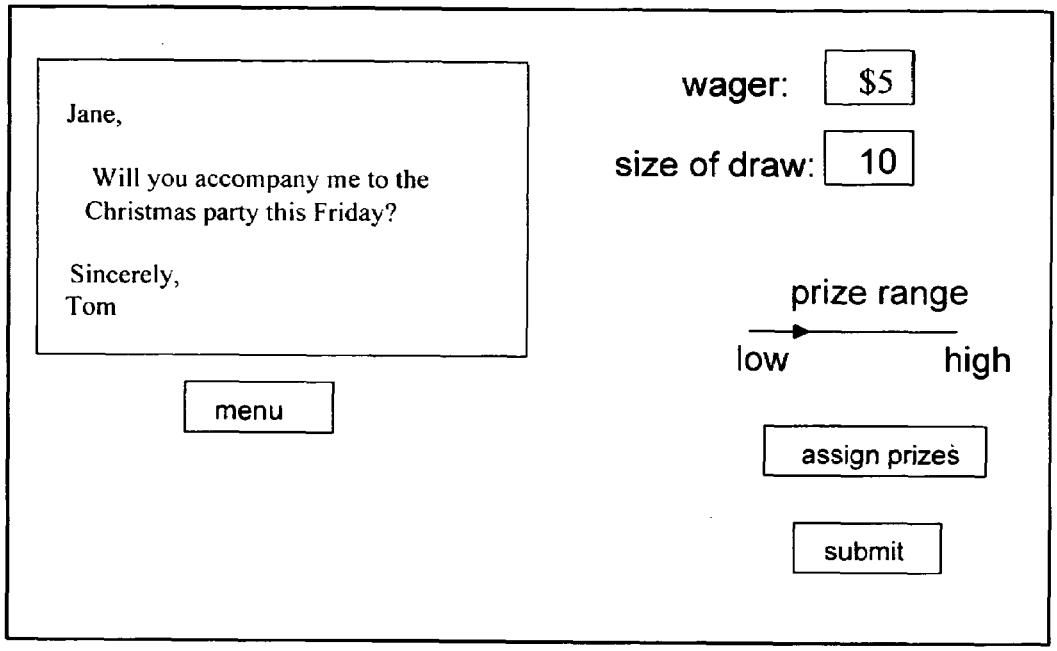
FIG. 46 is a graphical user interface system for a lottery station according to the invention.

A player may input and receive information to and from the lottery via a graphical user interface linked to the lottery computer system as illustrated in FIG. 46. Such an interface may be at a player station or accessed via the Internet. The player supplies the wager and the number of letters in the draw. In FIG. 46, he has selected a wager of $5 and a draw size of 10. There are reasons why the player may wish to control the size of the draw: The draw size affects the probabilities, which affects the assignment of prizes. Also, he may want the draw size to be big enough to accommodate larger words. The player also has some control over the range of prizes. It has been illustrated above that the range of prizes can be controlled by a real-valued number k. On the graphical user interface is a scale controlling the prize range from low to high. Internally, this scale controls the value of k, which controls how the payouts for the individual words are allocated, which controls the prize values. In FIG. 46, he has set the prize range toward the low end, which means lower prizes.

Once the player has supplied the parameters, he provides the words. He may create the words himself or select from a menu of predefined sets of words. For example, he could press a menu button and have selected a quote or cliche. In FIG. 46, he has typed in:

"Jane, Will you accompany me to the Christmas party this Friday?Sincerely, Tom"

Figure 47:
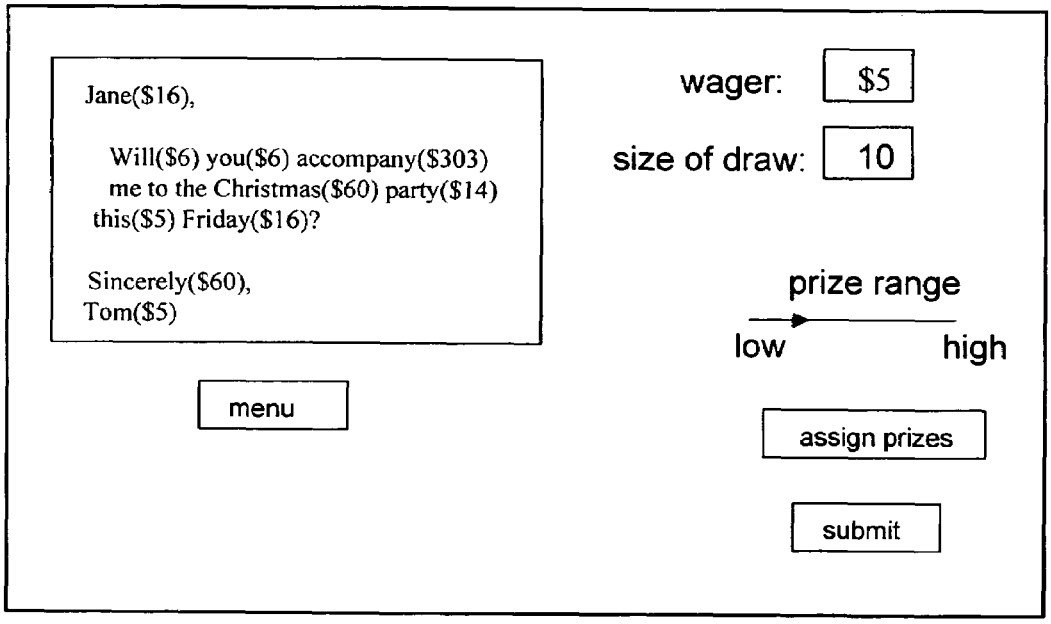
FIG. 47 illustrates a graphical user interface displaying a prize assignment.

At this point, he can have prizes assigned. Based on these parameters and the formula in FIG. 13, the player presses the "assign prizes" button. Prizes are assigned and displayed. As in FIG. 47, the assignment of the prizes is "Jane($16), Will ($6) you($6) accompany($303) me to the Christmas($60) party($14) this($5) Friday($16)? Sincerely($60), Tom($5)."

Once the player has created the words and prizes have been assigned, he may clear the interface and start again, or submit the words and prizes. Depending on the exact embodiment, the draw may occur at this time or the words and prizes may be memorialized on a ticket, and the draw occurs at a later time. If he is to play the game at the current time, there is no need to memorialize the game on a ticket. He is prompted to pay for the game, as in FIG. 48. The draw is performed and displayed. In the example in FIG. 49, the draw is A D H I M O S T U W, which confers "this" and "Tom" to be winners. The player wins a total of $5+$5=$10.

Figure 50:
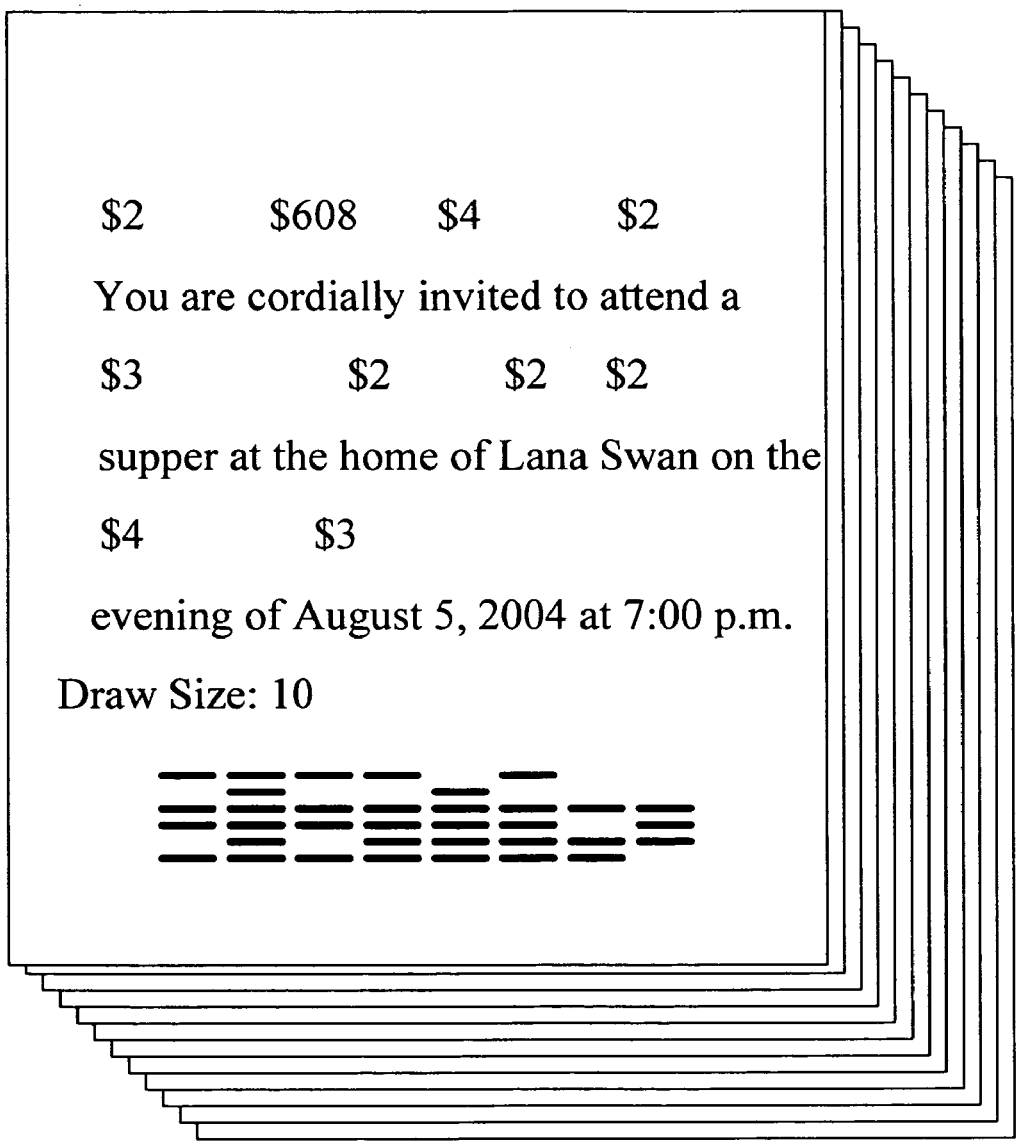
FIG. 50 illustrates a custom made ticket.
Figure 51:
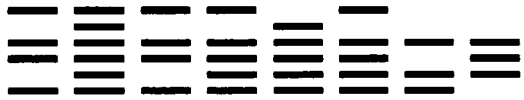
FIG. 51 illustrates a custom made ticket that includes a draw.

If the words and prizes are to be memorialized on a ticket, the ticket may be dispensed at the player station. FIG. 33 illustrates such a ticket. The player would pay for the draws, such as those in FIG. 34. Or the player may have the ticket or set of tickets custom-made. For example, FIG. 50 displays custom-made party invitations. One would take such a party invitation, submit it to a retailer for a fee, and receive a random draw. The lottery may charge for the service of allowing the player to create tickets. In a variation, the words and prizes may be memorialized on a ticket along with one or more random draws. This is illustrated in FIG. 51.

Figure 52:
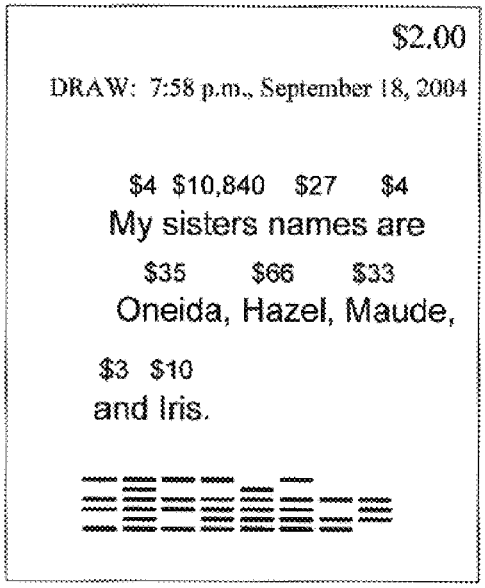
FIG. 52 illustrates a ticket for a daily draw.
Figure 53:
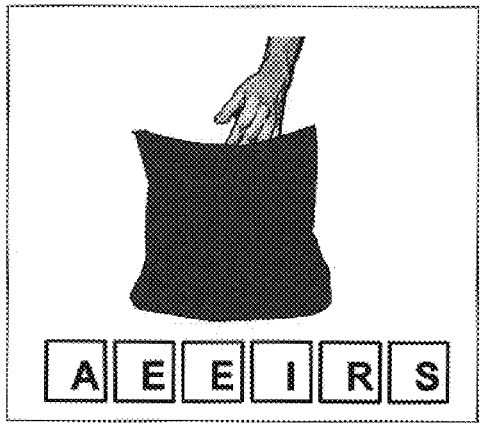
FIG. 53 illustrates a televised draw.

This invention can be embodied such that a draw takes place as a regular event and applies to a group of players. For example, the draw could be a daily event that would apply to all tickets assigned to that event. The daily draw could consist of drawing from the Scrabble® distribution (FIG. 39) without replacement. This draw could be accomplished in a number of ways such as having a person physically draw tiles from a bag, balls being produced from a hopper, or a computer simulation. Such an event could be a daily event. FIG. 52 illustrates a ticket for this embodiment that the player has created. The ticket is assigned the day of the draw. FIG. 53 illustrates the televised draw corresponding to this ticket. For the draw, 7 tiles are physically drawn from a bag. In this example, the rule for winning is that a word can be composed with the drawn letters, requiring repetition as needed. In the example in FIGS. 52 and 53, the player wins $4 for the word "ARE" as the letters "A," "R" and "E" are contained in the draw.

Figure 55:
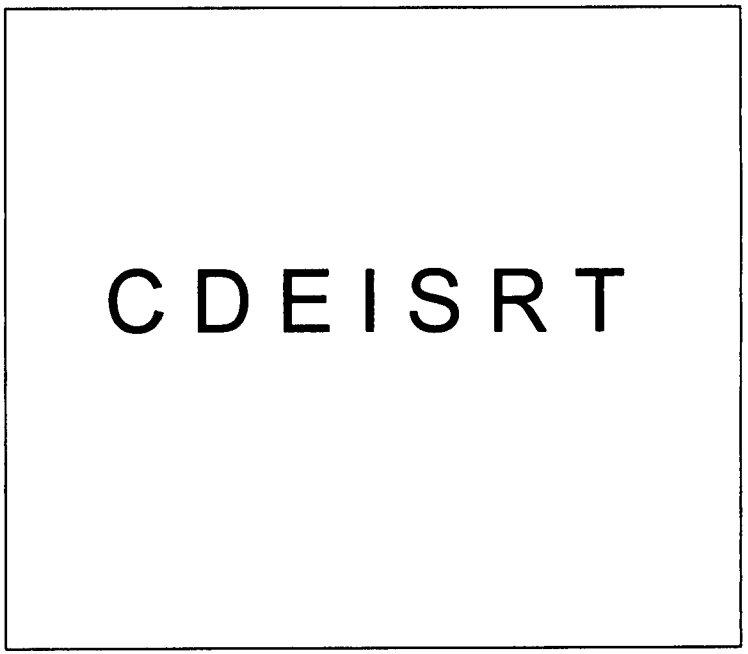
FIG. 55 illustrates a result for the monitor game of FIG. 54.
Figure 54:
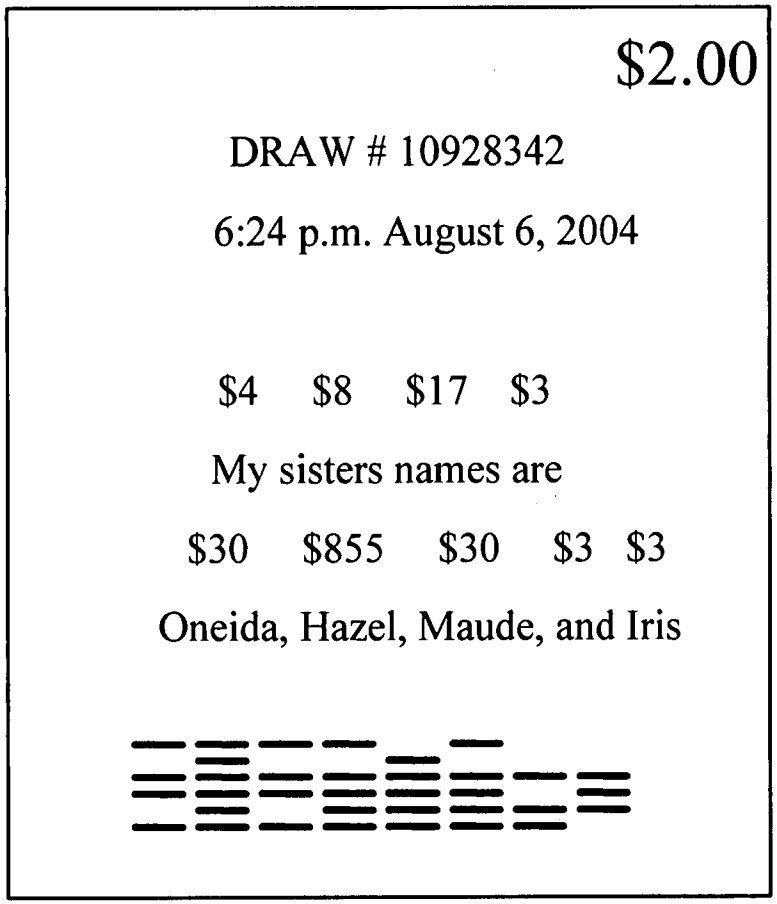
FIG. 54 illustrates a ticket for a monitor game.

This invention could also be implemented as a fast-paced monitor game. For example, the draws could take place every 5 minutes and the same draw displayed on monitors throughout a jurisdiction. FIG. 54 illustrates a ticket for such an event. The player has created his own ticket, such as at a player station. The ticket is assigned a specific draw. The outcome of the draw would be displayed on monitors, as in FIG. 55. If he cares to play again using the same words, he could exchange this ticket for an identical ticket, except that it is assigned to a different draw.

Figure 56:
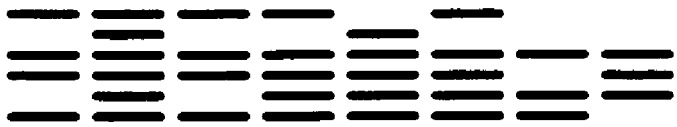
FIG. 56 illustrates a custom made instant ticket.
Figure 57:
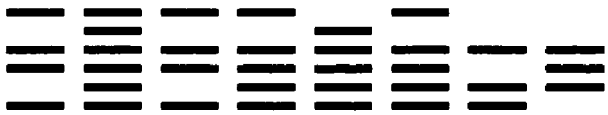
FIG. 57 illustrates a paper ticket corresponding to the instant ticket of FIG. 56.

Having the draw comprise a regular event could be embodied with an instant ticket. FIG. 56 illustrates an instant ticket that was created by an individual and given as a gift. To enter in a draw, the player pays the price point and receives a paper ticket corresponding to the instant ticket memorializing the entry into the draw, such as in FIG. 57. This particular ticket displays the odds and prizes for the words on the instant ticket as well as the overall odds. The instant ticket can be used as many times as the player desires.

We illustrate an embodiment of this invention in which an entry is a set of puzzles, letters are drawn as balls from a hopper, and prizes are based on the number of puzzles the player is able to complete with the drawn letters. For this embodiment prizes are assigned to subsets of words, as opposed to individual words. For example, there are prizes for completing, 2, 3, or 4 puzzles. For $2, a player purchases a ticket as illustrated in FIG. 60. The ticket displays 4 puzzles. Each puzzle is a word or phrase with letters indicated as missing. There is an "answers section" displayed upside down on the ticket that indicate the completed puzzles so there is no ambiguity as to the solutions. For the purposes of this invention, the solutions to such puzzles are "words," as each puzzle's missing letters is a concatenation of letters. For example, the set of "words" for the ticket in FIG. 60 can be thought of as G, DK, BQ, BDG, as these are the solutions to the puzzles.

For this embodiment, ten letters, A, E, I, L, N, O, R, S, T, are designated as "given." A puzzle is defined to be any word or phrase for which the letters that are not among those given are identified as "missing." For example, for the word "CORNBREAD," the letters that are not among the 10 given letters are B, C, and D. On the ticket, the puzzle could be displayed as -ORN-REA-, with dashes replacing these letters. The solution to this puzzle is BCD as those comprise the missing letters.

Figures 61, 62:
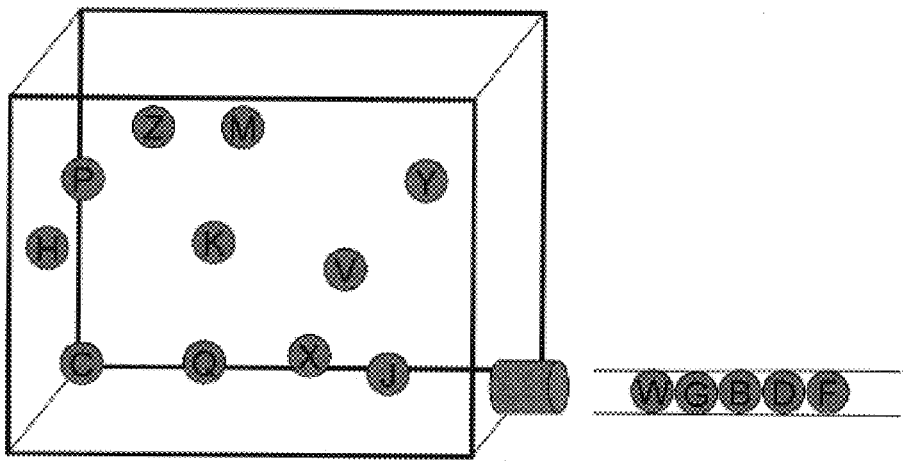
FIG. 61 illustrates a prize table for an embodiment for which puzzles are used
FIG. 62 illustrates balls identified with letters being drawn for an embodiment based on puzzles.

The lottery subsequently draws 5 letters from among the 16 letters that are not given. This can be done by mixing 16 lettered balls in a hopper and producing 5 balls, the same way lottery drawings are conducted using numbered balls. FIG. 61 illustrates a draw of BDFGW. The rule by which a draw confers a puzzle a winner is if the drawn letters complete the puzzle, using a letter as many times as needed. For example, for the ticket in FIG. 60 the solution to puzzle 4 is "BDG", as those letters complete -A-E ("BADGE"). As the draw contains B, D, and G, puzzle 4 is conferred a winner. The draw also completes -REEN ("GREEN"), so that puzzle 1 is also conferred a winner. Thus, BDFGW confers a total of 2 winners for the set of puzzles in FIG. 60. Prizes are assigned based on the number of completed puzzles as described in FIG. 61. As the player is able to complete two of the puzzles with the drawn letters, he wins $4. Having described this embodiment, in general, we now provide a detailed description of how it would be implemented.

First, the 16 letters (i.e. excluding the 10 given letters) are partitioned into matrices: Matrix 1: B, C, D, G, H, M, P, Y and Matrix 2: F, J, K, Q, V, W, X, Y, Z. Roughly speaking, the letters in Matrix 2 are less common and more difficult to combine than those in Matrix 1.

Secondly, a database of puzzles is created based on 5 types: Type 1: solution comprises 1 letter from Matrix 1, Type 2: solution comprises 2 letters from Matrix 1, Type 3: solution comprises 3 letters from Matrix 1, Type 4: solution comprises 1 letter from Matrix 2, Type 5: solution comprises 1 letter from Matrix 1 and 1 from Matrix 2. For example, the puzzle -ORN-REA-, the solution to which is BCD for "CORNBREAD," is a Type 3 puzzle. FIG. 63 illustrates a database of puzzles created for this embodiment. This database covers every conceivable solution for the 5 types. For example, a Type 5 puzzle comprises 1 letter from Matrix 1 and 1 letter from Matrix 2. Given any letter from Matrix 1 and any letter from Matrix 2 there is a puzzle in the database with that solution, e.g. to the solution HY is the puzzle "HONEY" (which would be displayed as -ONE- on a ticket). There are a total of 164 different puzzles for the 5 different types.

Thirdly, functions are defined that take as input permutations of letters from Matrix 1 and Matrix 2 and output a set of solutions to puzzles. These functions are illustrated in FIG. 64. As an example, consider Function 2, which is defined as: $X_1$ for puzzle 1, $Y_1$ for puzzle 2, $X_2Y_2$ for puzzle 3, and $X_1X_2X_2$ for puzzle 4. Given random permutations HYDBC from Matrix 1 and VKFWX from Matrix 2, Function 2 produces: H for puzzle 1, V for puzzle 2, KY for puzzle 3, and DHY for puzzle 4. By the database in FIG. 63, puzzles corresponding to these solutions are S-OE ("SHOE"), OLI-E ("OLIVE"), -E-("KEY"), and T-URS-A-("THURSDAY"). These functions are such that any solution produced is one of the 5 Types of puzzles discussed above. (For example, S-OE ("SHOE") is a Type 1 puzzle.) This guarantees that for any solution there is a puzzle in the database in FIG. 63 that has that solution.

These functions will be used in assigning content to tickets as follows: Weights $w_1, \ldots, w_6$, (i.e. a probability distribution) are assigned to the functions. When a player makes a purchase, one of these 6 functions will be randomly assigned in proportion to its weight. Following, permutations from Matrix 1 and Matrix 2 will be randomly generated and input to the function to produce a set of puzzles. This will take place instantly from the player's point of view. These puzzles will be memorialized on a ticket as in FIG. 60.

To determine appropriate weights for these functions, various goals should be kept in mind. The return to the player should be acceptable, (.e.g, it may be desired that the return be fall between 50% and 55%.) Also, it may be desirable that the return be relatively constant between draws. A set of weights can be determined that meets these goals by using linear algebra. A system of constraints will be set up and solved to determine $w_1, \ldots, w_6$ such that the return will be the same for all draws.

To set up such a system of constraints it is observed that there are 6 classes of draws based on the number of letters from Matrix 1 and Matrix 2: Class 1: 5 letters from Matrix 1, Class 2: 4 letters from Matrix 1 and 1 letter from Matrix 2, Class 3: 3 letters from Matrix 1 and 2 letters from Matrix 2, Class 4: 2 letters from Matrix 1 and 3 letters from Matrix 2, Class 4: 1 letter from Matrix 1 and 4 letters from Matrix 2, and Class 6: 5 letters from Matrix 2. Every possible draw is in one of these classes. Moreover, it is clear that for any two draws within the same class the return is the same regardless of the weights on the functions. For example, the draw BCDVX and the draw GHJKY are each Class 3 draws. As each draw contains exactly 3 letters from Matrix 1 from 2 from Matrix 2, the return is the same for each of these draws.

Before we define a system of constraints, we show that for each class of draws, the return can be expressed as a linear combination of the weights $w_1, \ldots, w_6$. As an example, take a Class 3 draw-3 letters from Matrix 1 and 2 letters from Matrix 2. BCDFJ is such a draw. Since the return is the same for all draws within the same class, it is sufficient to work out the example for BCDFJ as the return for any other draw in Class 3 produces the same return. We derive a linear combination for the return on draw BCDFJ by computing the return attributable to each of the 6 functions and taking the total. For example, one skilled in the art of combinatorial Mathematics can assert that Function 1 produces a total of 1,680 distinct equally likely sets of puzzles. Out of those, 90 can be identified such that BCDFJ wins exactly 2 puzzles. Observe that it is not possible for BCDFJ to win 3 or 4 puzzles for a set of puzzles produced by Function 1. As the prize for completing 2 puzzles is \$4 (FIG. 61) and the price is \$2, and the weight for Function 1 is $w_1$, the return on BCDFJ attributable to Function 1 is (90/1,680)×\$4/\$2 $w_1$=0.1071428571 $w_1$. Continuing, one skilled in the art of combinatorial Mathematics can assert that Function 2 produces a total of 18,816 distinct equally likely sets of puzzles. Of those, 2,340 can be identified such that BCDFJ completes exactly 2 puzzles, 204 can be identified such that BCDFJ completes exactly 3 puzzles, and 12 can be identified such that BCDFJ completes all 4 puzzles. As the prizes for completing 2, 3, and 4 puzzles are \$4, \$50, and \$500 respectively, the price is \$2, and the weight for Function 2 is $w_2$, the return on BCDFJ attributable to Function 2 is [2,340×\$4+204×\$50+12×\$500]$w_2$/18,816/\$2=0.0792091837$w_2$. Therefore, the return on BCDFJ attributable to Function 2 is 0.1071428571$w_2$. Continuing with the remaining functions, the return attributable to Function 3 is 0.3258928571$w_3$, the return attributable to Function 4 is 0.5931122449$w_4$, the return attributable to Function 5 is 0.2053571429$w_5$, and the return attributable to Function 6 is 0.4285714286$w_6$. The total return for the draw BCDFJ, is the sum of these expressions $$0.1071428571w_1+0.1071428571w_2+0.3258928571w_3+0.5931122449w_4+0.2053571429w_5+0.4285714286w_6.$$

Therefore, the return for a draw from Class 3 can be expressed as a linear combination of the weights $w_1, \ldots, w_6$. Similarly, the returns for the various classes of draws can be expressed by the linear combinations of $w_1, \ldots w_6$ as summarized in FIG. 65.

One is now in a position to set up a system of constraints. As it is desired that the return be the same for each draw, we let R be a constant and set each of the linear combinations in FIG. 65 equal to R. We also include the constraints that require each of the weights be greater than or equal to 0 and that they sum to 1. We now have a system of constraints as illustrated in FIG. 66 that can be solved. Solutions to R, $w_1, \ldots, w_6$ are illustrated in FIG. 67. The return R turns out to be 54.77%. If this return were too high or too low, the prize table in FIG. 61 could be rescaled and the problem reworked.

In summary, this embodiment is conducted as follows: A player pays a \$2 wager to enter the game. One of the functions in FIG. 64 is randomly selected based on the weights in FIG. 67. A permutation of 5 letters from Matrix 1 (B,C,D,G,H,M,P,Y) is randomly generated and a permutation of 5 letters from Matrix 2 (F, J, K, V, W, X, Y, Z) is randomly generated. These permutations are input to the function and solutions to 4 puzzles are generated. Actual puzzles that have these solutions are retrieved from a database such as that represented in FIG. 63. These puzzles are memorialized on a ticket as illustrated in FIG. 62. A draw is conducted by the lottery in which 5 letters are randomly selected from among B,C,D,F,G,H,J,K,M,P,V,W,X,Y,Z. The prize table for this game is illustrated in FIG. 61. The system for assigning puzzles to a ticket is such that this game returns 54.77%. Moreover, the return is the same regardless of the draw so that the payout to the player should be relatively constant over a series of draws.

As a matter of policy, these tickets should be non-cancelable. This guarantees the tickets entered into the game conform to the above discussed weighting system and that the return is 54.77%.

Figure 68:
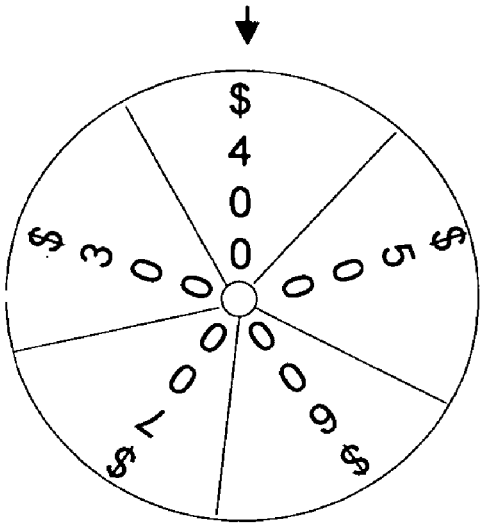
FIG. 68 illustrates a ticket for which the top prize varies per ticket and is represented by a value on a wheel.

It should be noted that it is not necessary that the prizes for the above embodiment be constant. FIG. 68 illustrates a variation of this embodiment for which the top prize for completing 4 puzzles is not a fixed \$500, but rather varies evenly between \$300, \$400, \$500, \$600, and \$700. Each ticket is randomly assigned one of these values and it is represented to the player as a "wheel" landing on that value. In FIG. 68 the top prize is indicated as \$400. This is what the player will win if he completes all 4 puzzles with the draw. Note that despite the fact that the value of the top prize varies, the average value of the top prize is still \$500. Therefore, the overall return would not be affected and would still be 54.77%

Figure 58:
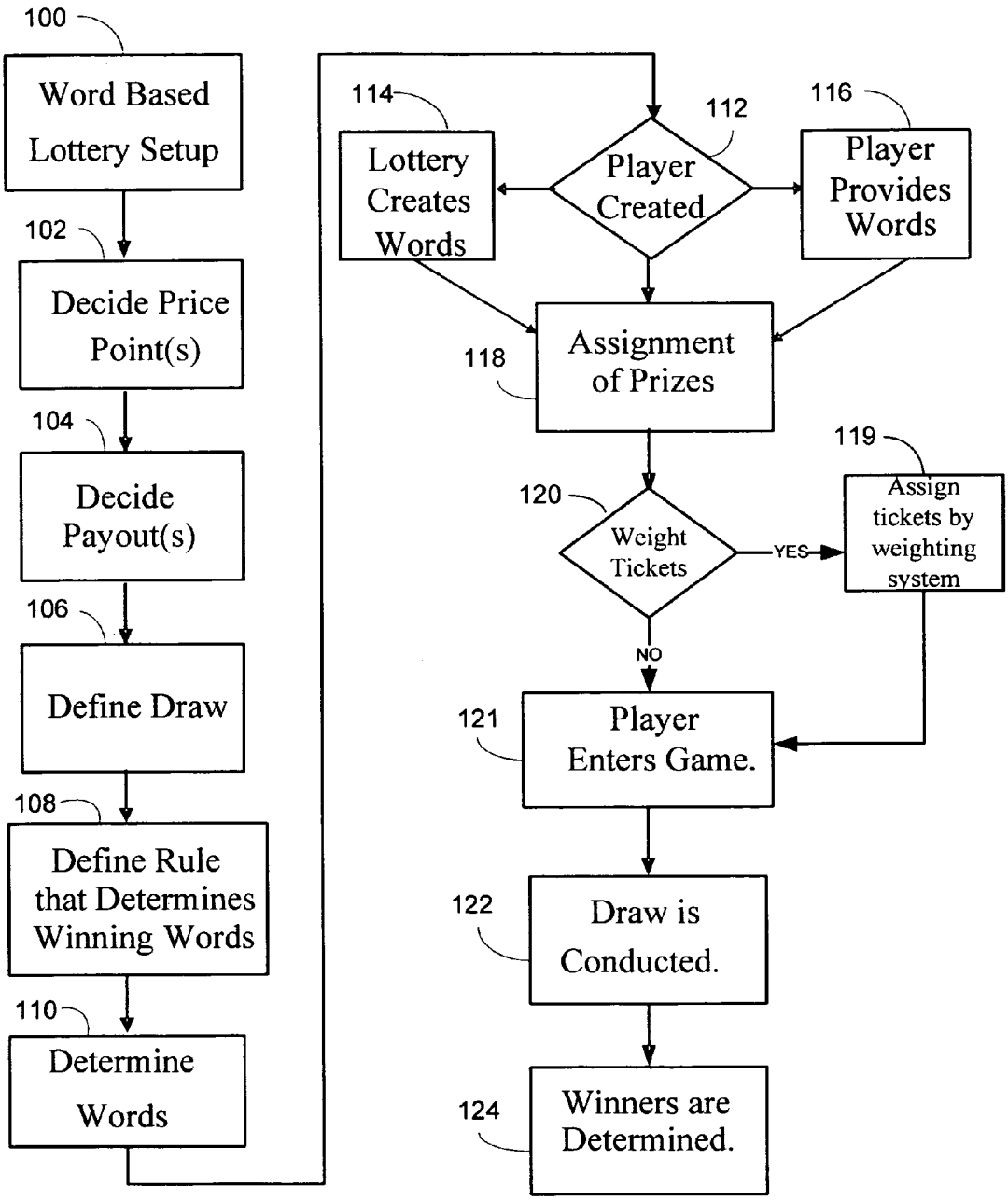
FIG. 58 is a flow chart for the invention.

The general routine for implementing this invention as summarized in the flowchart in FIG. 58 will now be described. First, the lottery must decide the price points, block 102, and payouts for the game, block 104. There could be a variety of price points and payouts. For example, it may be the case that the payout increases with the player's wager.

The draw must be defined, block 106. The draw must be a random process, the outcome of which is a concatenation of characters and must be such that every possible outcome can be assigned a probability of occurrence. One example is randomly drawing objects identified with letters, with or without replacement. In another example, a concatenation of letters can be randomly generated from a probability distribution. The exact method of draw can be such to allow or exclude repetition. The player could also produce the draw himself by selecting cells on a playslip or scratching squares on an instant ticket. The draw may also allow wildcards that can be substituted for any letter. Also, the draw could contain a constant set of letters. For example, in FIG. 35 the draw always includes E, L, N, R, S, and T.

A draw can be such that it applies to one player at a time. This would be the case when the draw is instantly produced as described above and in FIGS. 26-35. In this case, the player may be allowed some control as to how the draw is conducted. For example, the player may be able to specify the number of letters in the draw. There are embodiments for which a single draw could apply to multiple players. This would be the case if the draw is a regular event, such as a daily or a monitor game.

There are embodiments for which the player himself performs the draw as illustrated above and FIGS. 40-44 illustrate an example of a single prize table comprising a set of words and an assignment of prizes that applies to all players. The player produces the random draw by blindly selecting the concatenation of characters.

Once the draw has been defined, a rule must be established by which an outcome of the draw can confer a word a winner, block 108. Most straightforwardly, an outcome can confer a word a winner if the word can be formed from the letters in the outcome. The rule may allow a letter in the outcome to be used as many times as needed, or the rule may require that letters in the outcome be repeated as many times as in the word. Other examples of rules include conferring a word a winner if the word contains the outcome. Once the rule by which an outcome of the draw confers a word a winner has been established, a word can be assigned a probability of winning: As each outcome of the draw can be assigned a probability of occurrence, the probability that a word will win is the sum of all outcomes that confer that word a winner.

The set of words to be used must be set, block 110. Either the lottery, block 114, or the player, block 116, provides the words. The lottery could predetermine appropriate sets of words, (e.g. quotes, lists related by theme, humor, etc.) and randomly assign the player a set of words. An embodiment could allow one single set of words, such a master list of words, as in FIG. 40, perhaps numbering in the tens, hundreds or thousands that would apply to all players. The lottery could revise or interchange such a list periodically.

The set of words could also be puzzles where a puzzle is a word in the sense that its missing letters are a concatenation of letters. For example, if the puzzle is -U--LE-U- ("BUBBLE GUM") the "word" is BGM, the solution to the puzzle. If puzzles are to be used, the lottery must assemble puzzles suitable for the game.

It may be possible for the player to create the words himself. For example, the words could be a note to friend or an invitation. The player could input his words to the lottery via a graphical user interface such as at a player station or via an Internet connection.

As a compromise between the lottery assigning the player a set of words and the player providing the words himself, the player could select the set of words from a menu of sets of words provided by the lottery.

Once the price, payout, draw, rule for winning, and the set of words have been set, prizes are assigned to the words or subsets of words, block 118. For the case for which prizes are assigned to individual words, there are two steps to assigning prizes to the words: First, it must be decided how the payouts for the individual words must be allocated. Second, the formula in FIG. 13 is applied. The payouts for the individual words can be allocated in any manner that results in the total of the payouts for the individual words being the set payout for the game. Most straightforwardly, the payouts can be allocated equally simply by dividing the set payout for the game by the number of words.

The lottery may decide on the scheme for assigning prizes or the player may be allowed some control. For example, the allocation of payouts to the individual words may be controlled by a number as discussed above and in FIGS. 17-20. In general, as k decreases, the range of prizes increases. By adjusting this parameter, the player would be able to scale the prize range from low to high such as via a graphical user interface.

It may be the case that prizes are to be assigned to subsets of words, rather than individual words. For example, if the set of words is a set of solutions to puzzles, prizes may be awarded based on the number of puzzles won vs. specific prizes to individual words. If this is the case, a determination needs to be made to whether the tickets are to be weighted, as shown at decision 119, and tickets are then weighted, block 120. That is, there should be some system by which the content of the ticket is distributed so as to guarantee an appropriate return. We have discussed an embodiment where puzzles are assigned to tickets based on a system of weighted functions.

Once the words have been assigned prize values and the tickets weighted, if necessary, the player can enter the game, block 121. The player pays a fee and is entered into the lottery's system. For example, there could be a record in a database including pertinent information such as his wager (if the wager is allowed to vary), the set of words and prize assignment, and information that identifies the draw such a number, code, or time.

The game is consummated once the draw is conducted and disclosed, block 122. The outcome determines which words are winners and the prizes to be awarded, block 124.

While there has been shown several embodiments of the present invention, it is to be appreciated that several changes can be made to the steps of the invention and systems used without departing from the spirit and scope of the invention as set forth in the claims appended hereto.

What is claimed is:

1. A method of conducting a word based lottery game having a plurality of players, comprising the steps of:

for each game, the players wagering on an entry defined by a set of words;

in a random draw process, randomly generating an outcome that is a concatenation of characters, the draw being such that each outcome can be assigned a probability of occurrence;

defining a rule that confers the words in the player entry a win status based on the outcome of the draw producing characters that are used to form the respective words in the player entry;

selecting winning entries based on the words in an entry that are conferred a win status; and assigning a prize for each winning entry as a function of a value assigned to each of the words in the player entry formed by the randomly drawn characters, the value based on the commonality of the characters that form the words in the player entry.

2. The method of claim 1, wherein the random draw step further includes the step of drawing objects identified with characters from a set of objects.

3. The method of claim 1, wherein the random draw step further includes the step of generating a random concatenation of characters based on a probability distribution of characters.

4. The method of claim 1, wherein the draw is a concatenation of letters restricted to outcomes that contain no repetition.

5. The method of claim 1, wherein the draw includes wildcards that can be substituted for any character.

6. The method of claim 1, wherein the draw includes a constant subset of letters.

7. The method of claim 1, wherein the random draw step further includes the step of making a blind selection by a player.

8. The method of claim 1, wherein the random draw step further includes the step of scratching places on a game card.

9. The method of claim 1, wherein the draw is an event that applies to a plurality of entries.

10. The method of claim 1, wherein the draw applies to an individual entry.

11. The method of claim 1, wherein a word conferred a win status for an entry includes an instance of a character in a draw used many times.

12. The method of claim 1, wherein a word conferred a win status for an entry includes an instance of a character in a draw used at most once.

13. The method of claim 1, wherein the step of defining a rule further includes the step of ignoring the delimiters.

14. The method of claim 1, wherein a winning entry contains all of the characters in the outcome of the draw used to form the words in the player entry.

15. The method of claim 1, wherein prizes are assigned to individual words so that the return is the same for each entry.

16. The method of claim 1, wherein prizes are assigned to subsets of words and entries are assigned to players so that the plurality of entries yields a certain return.

17. The method of claim 1, wherein prizes are assigned to subsets of words and entries are assigned to players so that the return for the plurality of entries is independent of the draw.

18. The method of claim 1, further comprising the step of memorializing each entry on a ticket.

19. The method of claim 1, further comprising the step of producing the outcome of the draw instantly at a terminal and printing it on a separate ticket.

20. The method of claim 1, further comprising the step of memorializing each entry and the outcome of the draw on the same ticket.

21. The method of claim 1, further comprising the step of memorializing each entry on a game card.

22. The method of claim 21, wherein a draw event is assigned to the game card at a terminal and printed on a ticket.

23. The method of claim 21, wherein the outcome of a draw is produced at a terminal and printed on a ticket.

24. The method of claim 1, wherein the player creates his own entry including the steps of:

providing a set of words;

setting the size of the draw; and determining the potential prizes by allocating payouts to individual words.

25. The method of claim 24, wherein the player creates the entry at a graphical user interface and for which the draw is conducted and displayed on the graphical user interface.

26. The method of claim 1, further comprising the step of recording the plurality of entries in a database.

27. The method of claim 1, further comprising the steps of:

entering the outcome of a draw into a database; and correlating entries into the game to determine the prize amounts each entry is entitled to.

28. A system for playing a lottery game, comprising:

a terminal for receiving user entries, wherein each entry includes a set of words; and a server in communication with the terminal, the server being capable of receiving entries, generating a random draw outcome, wherein the draw outcome is a concatenation of characters, assigning a win status to the words within an entry based on the outcome producing characters that are used to form the respective words in the player entry, selecting winning entries based on which words within an entry are conferred a win status, and assigning a prize for each winning entry as a function of a value assigned to each of the words in the player entry formed by the randomly drawn characters, the value based on the commonality of the characters that form the words in the player entry.

29. A system for playing a lottery game, comprising:

an input means for receiving user entries, wherein each entry includes a set of words;

a means for receiving entries from the input means;

a means for generating a random draw outcome, wherein the draw outcome is a concatenation of characters;

a means for assigning a win status to the words within an entry based on the outcome producing characters that are used to form the respective words in the player entry;

a means for selecting winning entries based on which words within an entry are conferred a win status; and a means for assigning a prize for each winning entry as a function of a value assigned to each of the words in the player entry formed by the randomly drawn characters, the value based on the commonality of the characters that form the words in the player entry.

* * * * *